US007699154B2

(12) United States Patent
Yoshioka

(10) Patent No.: US 7,699,154 B2
(45) Date of Patent: Apr. 20, 2010

(54) BILL HANDLING DEVICE

(75) Inventor: Kazuei Yoshioka, Koto-ku (JP)

(73) Assignees: Universal Entertainment Corporation, Tokyo (JP); Seta Corp., Tokyo (JP)

( * ) Notice: Subject to any disclaimer, the term of this patent is extended or adjusted under 35 U.S.C. 154(b) by 3 days.

(21) Appl. No.: 12/178,492

(22) Filed: Jul. 23, 2008

(65) Prior Publication Data

US 2009/0008214 A1 Jan. 8, 2009

Related U.S. Application Data

(62) Division of application No. 11/423,024, filed on Jun. 8, 2006, now Pat. No. 7,487,966.

(30) Foreign Application Priority Data

Jun. 17, 2005 (JP) ..... 2005-178272

(51) Int. Cl.
*G07F 7/04* (2006.01)

(52) U.S. Cl. ..... 194/206

(58) Field of Classification Search ..... 194/206
See application file for complete search history.

(56) References Cited

U.S. PATENT DOCUMENTS

| | | | | |
|---|---|---|---|---|
| 1,672,846 | A | 6/1928 | Dalton | |
| 3,458,314 | A | 7/1969 | Linowitzki et al. | |
| 4,345,752 | A * | 8/1982 | Nakamura et al. | 271/12 |
| 4,616,817 | A | 10/1986 | Yamauchi et al. | |
| 4,718,657 | A * | 1/1988 | Otter et al. | 271/184 |
| 5,267,826 | A * | 12/1993 | Peters | 414/789.9 |
| 5,653,436 | A | 8/1997 | Zouzoulas | |
| 5,662,202 | A | 9/1997 | Suris | |
| 5,769,412 | A | 6/1998 | Takemoto et al. | |
| 5,803,227 | A * | 9/1998 | Stein et al. | 194/206 |
| 6,019,210 | A | 2/2000 | Matsunaga et al. | |
| 6,749,195 | B2 | 6/2004 | Chou | |
| 7,255,216 | B2 * | 8/2007 | Izawa et al. | 194/350 |
| 2002/0180136 | A1 | 12/2002 | Amari et al. | |
| 2007/0000822 | A1 | 1/2007 | Yoshioka | |

FOREIGN PATENT DOCUMENTS

| | | | |
|---|---|---|---|
| CA | 2 460 555 | A1 | 9/2004 |
| CN | 1142216 | A | 2/1997 |
| CN | 2515734 | Y | 10/2002 |
| EP | 6-162320 | | 6/1994 |
| EP | 0 651 356 | A1 | 5/1995 |
| EP | 0 673 866 | A2 | 9/1995 |

* cited by examiner

*Primary Examiner*—Patrick Mackey
*Assistant Examiner*—Mark Beauchaine
(74) *Attorney, Agent, or Firm*—Oblon, Spivak, McClelland, Maier & Neustadt, L.L.P.

(57) ABSTRACT

A bill handling machine according to one embodiment of the invention is provided with a casing having a bill insertion slot provided on a front face of the casing to enable a bill to be inserted therein; a bill feeding device having a feeding belt wound at opposite ends around at least tension rollers provided on the upstream and downstream sides respectively along the bill insertion direction, and pinch rollers in contact with the tension rollers on the upstream and downstream sides, to feed the bill inserted from the bill insertion slot along the bill insertion direction. The distance between the pinch rollers in contact with the respective tension rollers on the upstream and downstream sides is set to be shorter than the distance between the tension rollers on the upstream and downstream sides.

4 Claims, 18 Drawing Sheets

BILL HANDLING DEVICE

CROSS REFERENCE TO RELATED APPLICATIONS

This application is a divisional of and is based upon and claims the benefit of priority under 35 U.S.C. §120 for U.S. Ser. No. 11/423,024, filed Jun. 8, 2006, and claims the benefit of priority under 35 U.S.C. §119 from Japanese Patent Application No. 2005-178272, filed Jun. 17, 2005, the entire contents of each which are incorporated herein by reference.

BACKGROUND OF THE INVENTION

The present invention relates to a bill handling device which is installed in a game hall where, for example, pachinko machines, slot machines (hereinafter, collectively referred to as a "game machine") and the like are installed, and which is capable of being disposed between game machines.

Generally, in a game hall such as a pachinko hall, for game player's convenience, in a region (also referred to as an "bank") where many game machines are installed, a vertically oriented game media lending apparatus (also referred to as a "sandwich apparatus") is installed between adjacent game machines to lend pachinko balls, coins (game media) and the like. The game media lending apparatus is attached to a frame fixed and installed between game machines, and actually lends game media and/or transmits a signal to urge to lend game media to a game machine by a bill, coin, prepaid card or the like being inserted through a corresponding insertion slot. For example, the bill handling device configured to handle bills is provided with a bill identifying portion that identifies an inserted bill, and a bill storage portion (safety box) that stores bills judged as being valid in the bill identifying portion.

For example, as disclosed in JP H06-162320, in order to feed bills inserted by a player, the above-mentioned bill handling device is provided with a pair of feeding belts wound around tension rollers, and pinch rollers in contact with the tension roller portions, and a bill inserted from an bill insertion slot is guided to a nip portion between the tension roller and pinch roller by a guide member, and further, guided along the bill identifying portion by the feeding belts. Then, a bill judged as being valid in the bill identifying portion is further fed downstream without change, and stacked and stored in the bill storage portion according to predetermined operation procedures.

In game halls, to effectively use the space, it is desired to efficiently install a large number of game machines, and with this desire, the bill handling device installed between the game machines is also required to reduce its size as much as possible. In other words, in the bill handling device, in order to reduce dimensions in the width direction, depth direction and vertical direction, it is necessary to effectively use the space for structural members disposed inside the casing, mode of their arrangement and the like.

In the bill handling device as disclosed in above-mentioned JP H06-162320, the pinch roller is brought into press-contact with the tension roller, around which the feeding belt is wound, in the direction perpendicular to the bill feeding direction. In a bill ejection portion, a predetermined distance is reserved from the nip portion between the tension roller and pinch roller on the ejection side. Therefore, when these mechanisms are applied to a sandwich apparatus installed between the machines, it is not possible to obtain sufficient size reduction. In other words, since the pinch roller is brought into press-contact in the direction perpendicular to the feeding direction, it is necessary to dispose force-applying means for the press-contact, and provide the space in the press-contact direction corresponding to the outer diameter of the pinch roller. Further, on the ejection side, subsequent processing (processing for stacking and storing the bill) can only be performed after a rear end of the bill is passed through the bill ejection portion, and some space is thus wasted in the bill handling direction.

Accordingly, such a bill handling device is required that enables various structural members to be efficiently disposed in the limited installation space and thus enables the compact size.

BRIEF SUMMARY OF THE INVENTION

In an aspect of the present invention, there is provided a bill handling device comprising: a bill insertion slot into which a bill is inserted; tension rollers provided respectively on an upstream side where the bill is inserted and on a downstream side where the bill is ejected, the tension rollers being mounted to a rotatable support shaft; a conveying belt wound around the tension rollers, the conveying belt conveying the bill inserted from the bill insertion slot; a pair of pinch rollers forming a nip portion in contact with the tension rollers while pinching the conveying belt between the upstream side and the downstream side; and a bill housing portion for housing the bill ejected from the nip portion between the tension roller on the downstream side and the pinch roller in contact with the tension roller, wherein: the nip portion between the tension roller and the pinch roller is set at a position offset by a predetermined angle formed in a direction orthogonal to a conveying direction of the bill from a lowest point of the tension roller so that said pair of pinch rollers is disposed inwardly of the tension rollers on the upstream and downstream sides; and wherein: the bill housing portion is provided at a position extending downwardly of the tension roller on the downstream side so as to house the bill ejected from the nip portion offset on the upstream side between the tension and the pinch roller.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

One embodiment of the present invention will be described below with reference to accompanying drawings.

Figure 1:
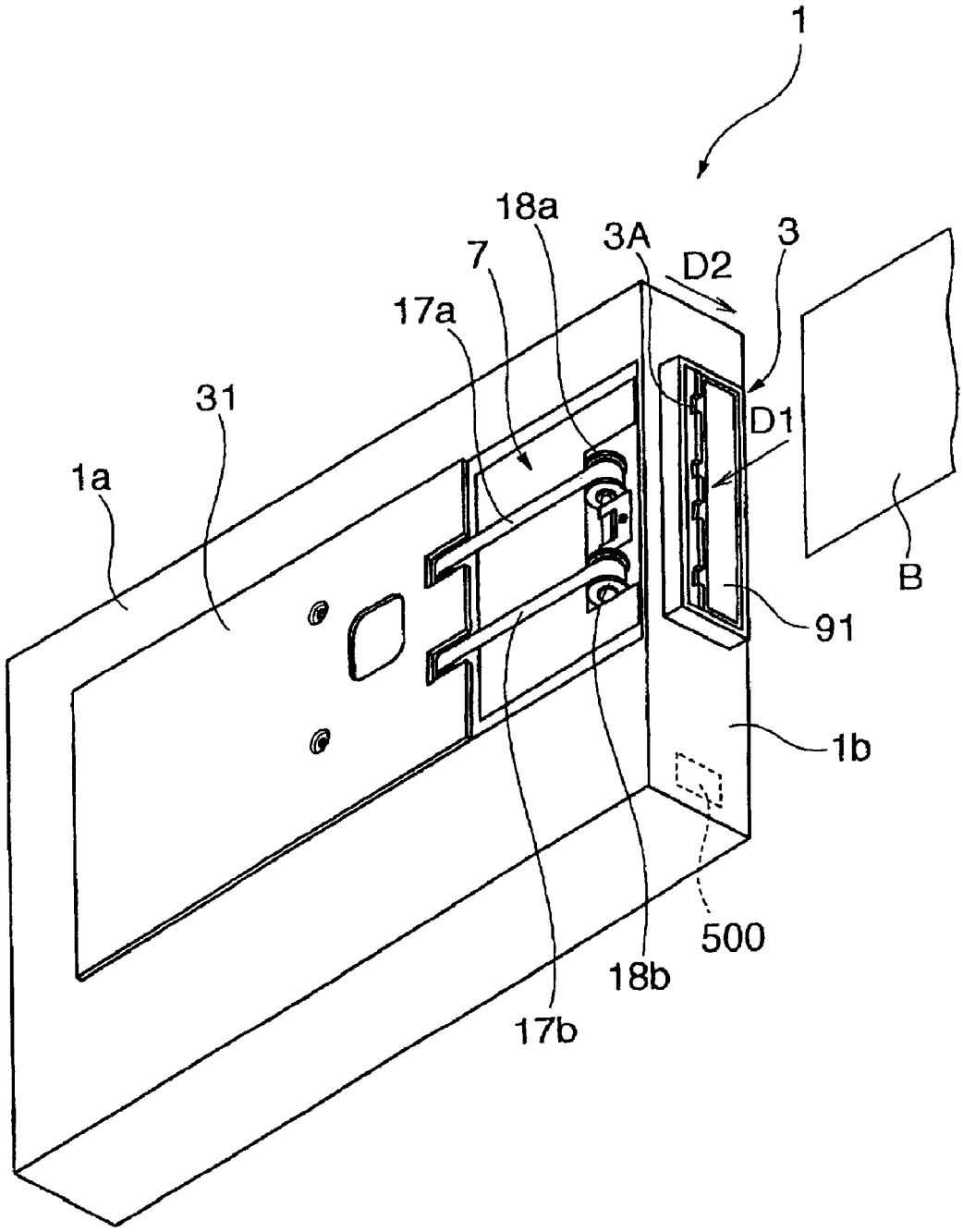
FIG. 1 is a perspective view showing an entire structure of a bill handling device according to the present invention.
Figure 2:
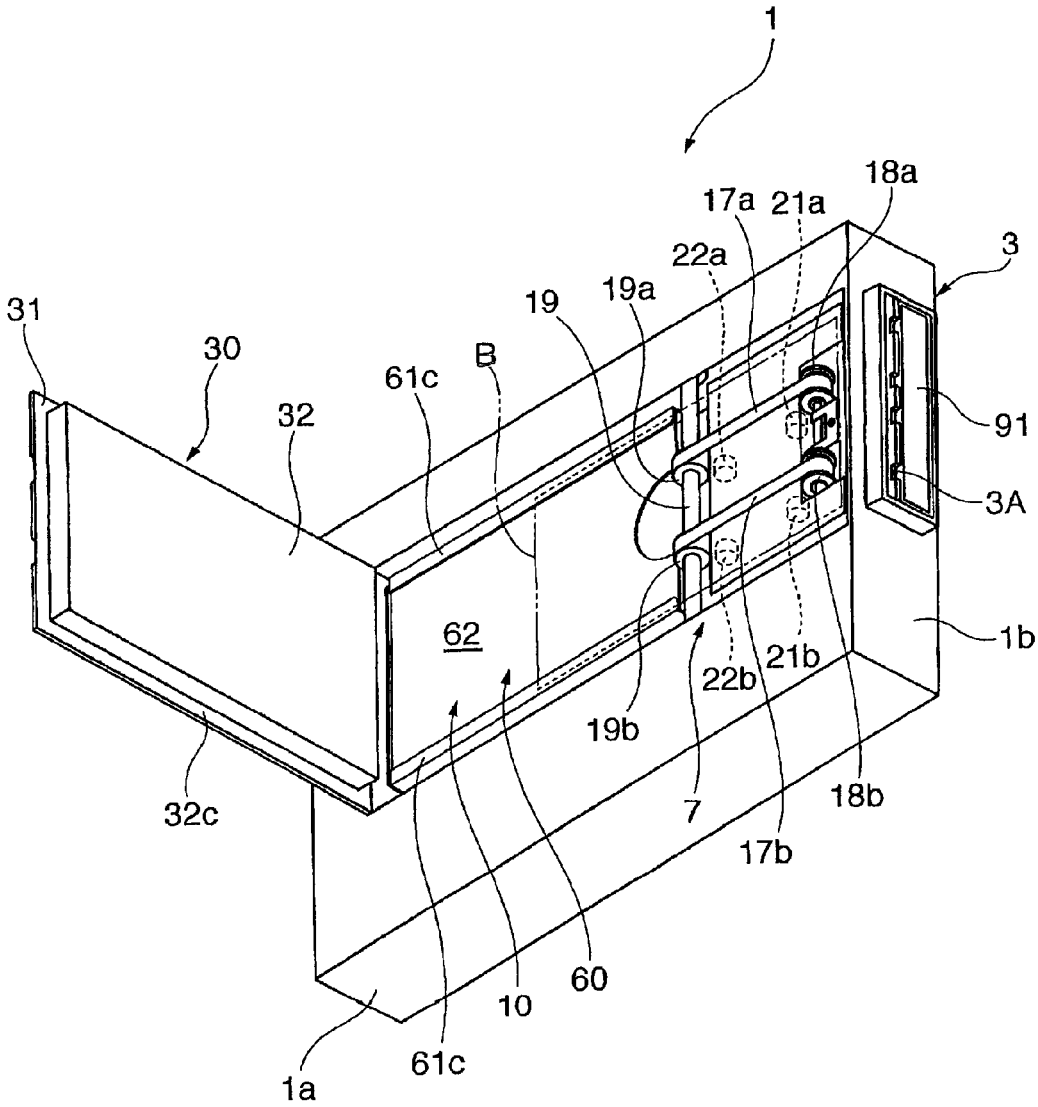
FIG. 2 is a perspective view showing a state where a cover member shown in FIG. 1 is opened.
Figure 3:
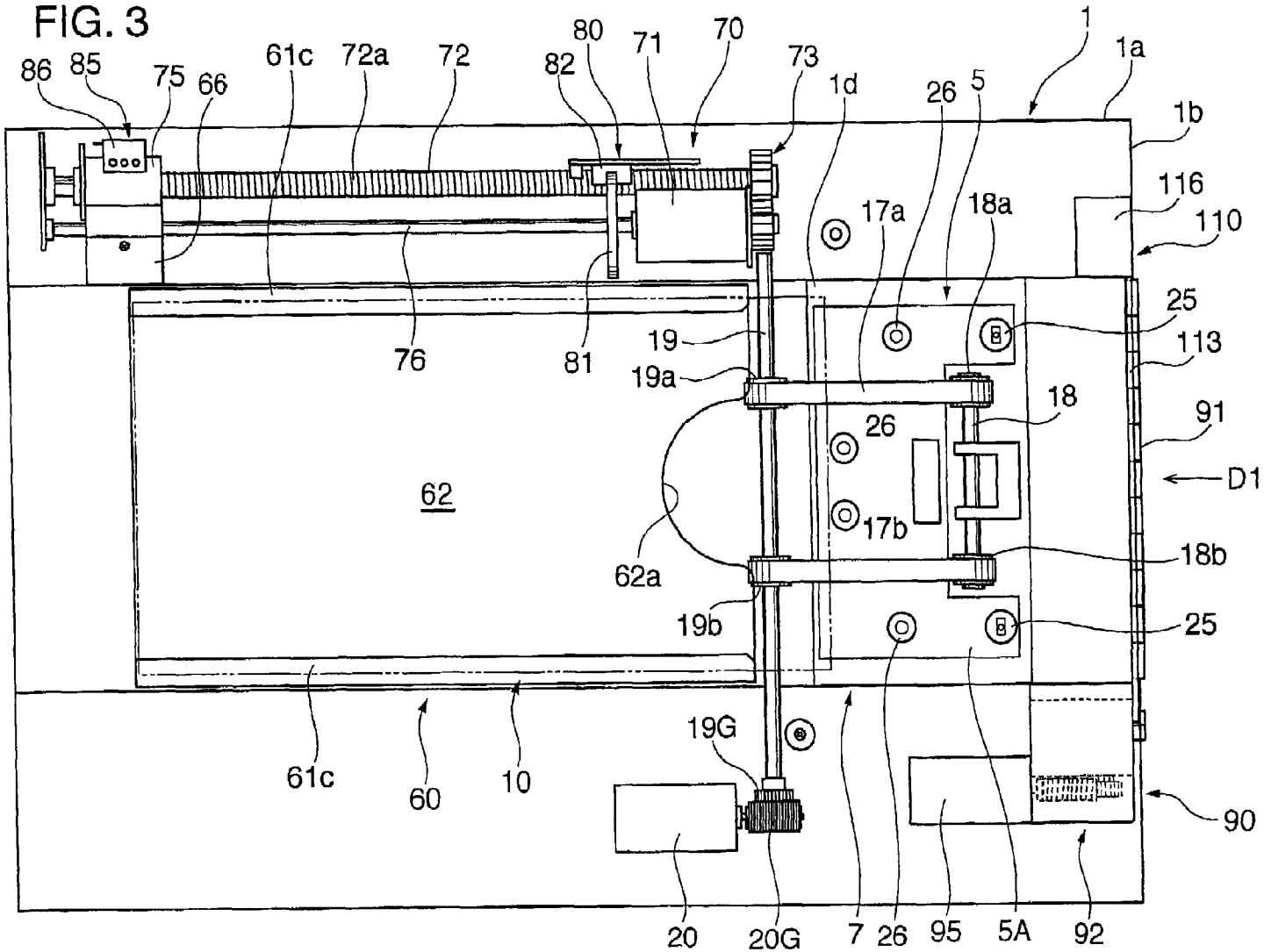
FIG. 3 is a plan view showing an internal structure of the bill handling device.
Figure 4:
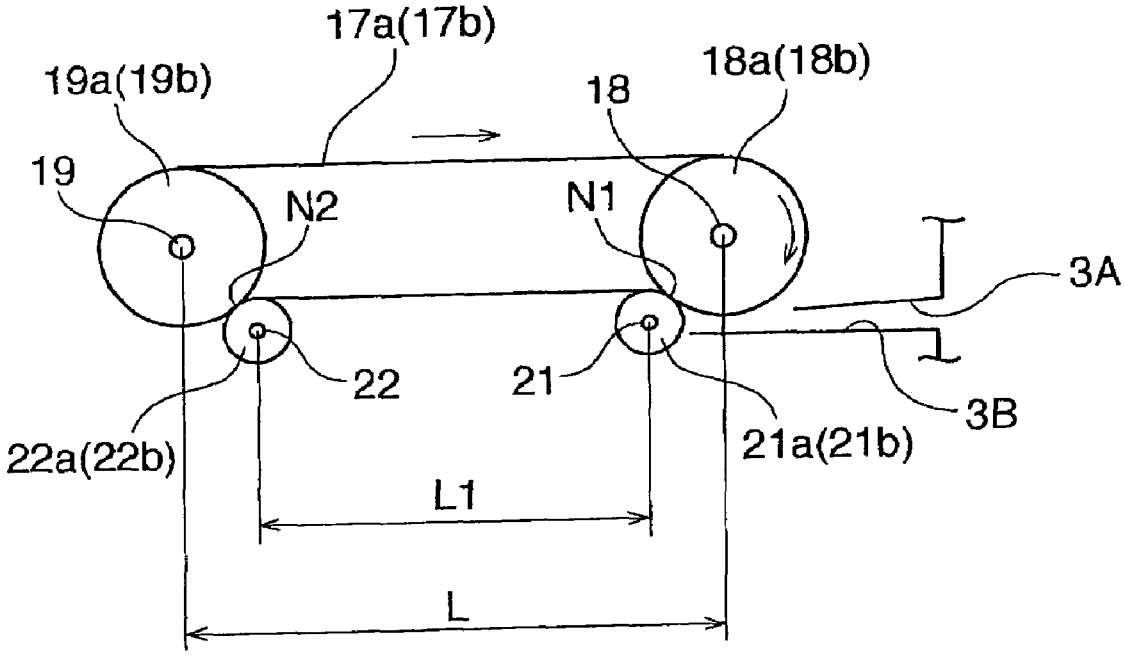
FIG. 4 is a view showing the relationship in contact between a tension roller around which a feeding belt is wound and a pinch roller in a bill feeding mechanism.

FIGS. 1 to 4 are views showing a structure of a bill handling device according to this embodiment. FIG. 1 is a perspective view showing the entire structure. FIG. 2 is a view showing a state where a cover member shown in FIG. 1 is opened. FIG. 3 is a plan view showing an internal structure of the device. FIG. 4 is a view showing the relationship in contact between a tension roller around which a feeding belt is wound and a pinch roller in a bill feeding mechanism.

The bill handling device 1 is configured to enable its installation into a game media lending apparatus installed between game machines such as, for example, pachinko machines, slot machines and the like (not shown). In this case, the game media lending apparatus is provided with other devices (for example, a coin identifying device, recording media handling device, power supply device and the like) above or under the bill handling device 1, and the bill handling device 1 may be integrated with the other devices or may be configured alone. Alternately, the bill handling device 1 may be installed alone or with the other devices in the space other than between game machines. Also, the bill handling device 1 may be incorporated within a game machine. Then, when a bill is inserted into such a bill handling device 1 and the validity of the inserted bill is judged, performed is processing of lending game media, processing of writing in a recording medium or the like corresponding to an amount of the bill.

The bill handling device 1 has a casing 1*a* formed in the shape of a cuboid, and the casing 1*a* is attached to an engagement portion of the game media lending apparatus not shown. A bill handling region 3 is formed on the front face (exposed face) 1*b* of the casing 1*a*. The bill handling region 3 is provided with a bill insertion slot 3A opened in the form of a slit to which a bill is inserted, and a openable/closable shutter (ejecting means) 91 which is formed to be adjacent to the bill insertion slot 3A and enables a mount tray (bill storage portion) on which bills are stacked and stored to be ejected. In this case, the bill B is inserted inside via the bill insertion slot 3A along the direction of the arrow D1 with short sides of the bill in the lengthwise direction (standing state).

In the casing 1*a* are provided a bill identifying portion 5 that identifies the validity of an inserted bill, and a bill feeding mechanism (a bill feeding device; bill feeding means) 7 that feeds the inserted bill. The bill identifying portion 5 is installed in the position near the bill insertion slot 3A in the insertion direction, and the bill feeding mechanism 7 is installed over a region along the insertion direction D1 from the bill identifying portion 5. In this case, the bill feeding mechanism 7 has the function of feeding the inserted bill while pinching the bill, and is configured in size accommodated within a region shorter than the length in the longitudinal direction of a bill, preferably, within a range less than half of the length of the bill in the position near the bill insertion slot 3A in the insertion direction.

In addition, on the downstream side of the bill feeding mechanism 7 is provided a bill push-in region 10 to slide a bill ejected by a pair of downstream-side rollers constituting the bill feeding mechanism without change. The bill push-in region 10 has substantially almost the same size as the size of the bill so that the region 10 is able to carry the bill ejected from the pair of downstream-side rollers toward the direction of the arrow D2 perpendicular to the ejection direction without any restrictions while keeping the state of the bill. The bill push-in region 10 is thus positioned on the downstream side of the bill feeding mechanism 7, and a bill pressing mechanism (a bill pressing device; bill pressing means) 30 is provided on one side of the casing, while a mount tray (bill storage portion; mount means) 60 is provided on the other side of the casing, to sandwich the bill push-in region 10. In other words, the bill ejected to the push-in region 10 by the feeding driving of the bill feeding mechanism 7 is pressed toward the direction of the arrow D2 by a pressing plate of the bill pressing mechanism 30 without change, and successively stacked and stored on the mount tray 60, as described later.

The bill feeding mechanism 7 extends along the bill insertion direction D1, and is provided with a pair of feeding belts 17*a*, 17*b* spaced a predetermined distance apart from each other. The feeding belts 17*a*, 17*b* are wound at one end around tension rollers (tension rollers on the upstream side) 18*a*, 18*b* attached to a spindle 18 supported rotatably by an internal frame 1*d* on the bill insertion slot 3A side, while being wound at the other end around tension rollers (tension rollers on the downstream side) 19*a*, 19*b* attached to a spindle 19 supported rotatably by the internal frame 1*d* at the back of the bill identifying portion 5, respectively.

The spindle 19 is rotary-driven by a feeding motor 20 disposed in the internal frame 1*d*. In other words, the spindle 19 is rotary-driven via a gear 20G fixed to a driving shaft of the feeding motor 20 and a gear 19G, engaging in the gear 20G, fixed to an end portion of the spindle 19. The feeding motor 20 is controlled to be driven in forward rotation and reverse rotation by control means (controller) described later, and has the function as a driving source of the bill feeding mechanism 7.

The tension rollers 18*a*, 18*b* and tension rollers 19*a*, 19*b* installed at opposite ends are respectively in contact with pinch rollers 21*a*, 21*b* and pinch rollers 22*a*, 22*b*. In this case, as shown in FIG. 4, the distance L1 between the pinch rollers 21*a* (21*b*), 22*a* (22*b*) respectively contacting the tension rollers 18*a* (18*b*), 19*a* (19*b*) at opposite ends is set to be shorter than the distance L between the tension rollers 18*a* (18*b*), 19*a* (19*b*) at opposite ends. In other words, a bill inserted into the bill insertion slot 3A is guided to a nip portion N1 between the tension roller 18*a* (18*b*) and pinch roller 21*a* (21*b*) by a guide 3B installed inside the casing, then fed while being pinched between the rollers, and finally, ejected to the bill push-in region 10 via a nip portion N2 between the tension roller 19*a* (19*b*) and pinch roller 22*a* (22*b*).

In addition, the tension rollers around which the feeding belts are wound may be provided at middle positions other than the opposite ends.

The bill identifying portion 5 has a sensor board 5A, and the sensor board 5A is provided with a bill insertion sensor 25 in a portion closer to the bill insertion slot 3A than the spindle 18. The bill insertion sensor 25 is comprised of, for example, an optical sensor, and detects that a bill is inserted into the bill insertion slot 3A. Then, when the bill insertion sensor 25 detects insertion of a bill, the control means described later rotary-drives (drives in forward rotation) the feeding motor 20 in the bill feeding direction.

On the bill sensor board 5A are further provided bill identifying sensors 26 installed between the spindles 18 and 19. Each of the bill identifying sensors 26 is comprised of an optical sensor to emit a light beam to a fed bill when the bill is fed by the bill feeding mechanism 7 as described above. The bill identifying sensors 26 are installed in a plurality of portions along the direction perpendicular to the bill insertion direction D1. A CPU of the control means described later compares detected data obtained by the reflected light and/or transmitted light from the bill with data on an authorized bill beforehand stored in ROM, and judges the validity of the bill.

The bill pressing mechanism 30 is provided on one side of the casing for the bill push-in region 10. The bill pressing mechanism 30 has a cover member 31 openable/closable relative to the casing 1*a*, a plate-shaped pressing plate 32 which is provided in the cover member 31 and presses a bill toward the direction of the arrow D2 when the bill is positioned in the bill push-in region 10 with the cover member closed relative to the casing 1*a*, and a plate driving motor that drives the pressing plate 32.

Figure 5:
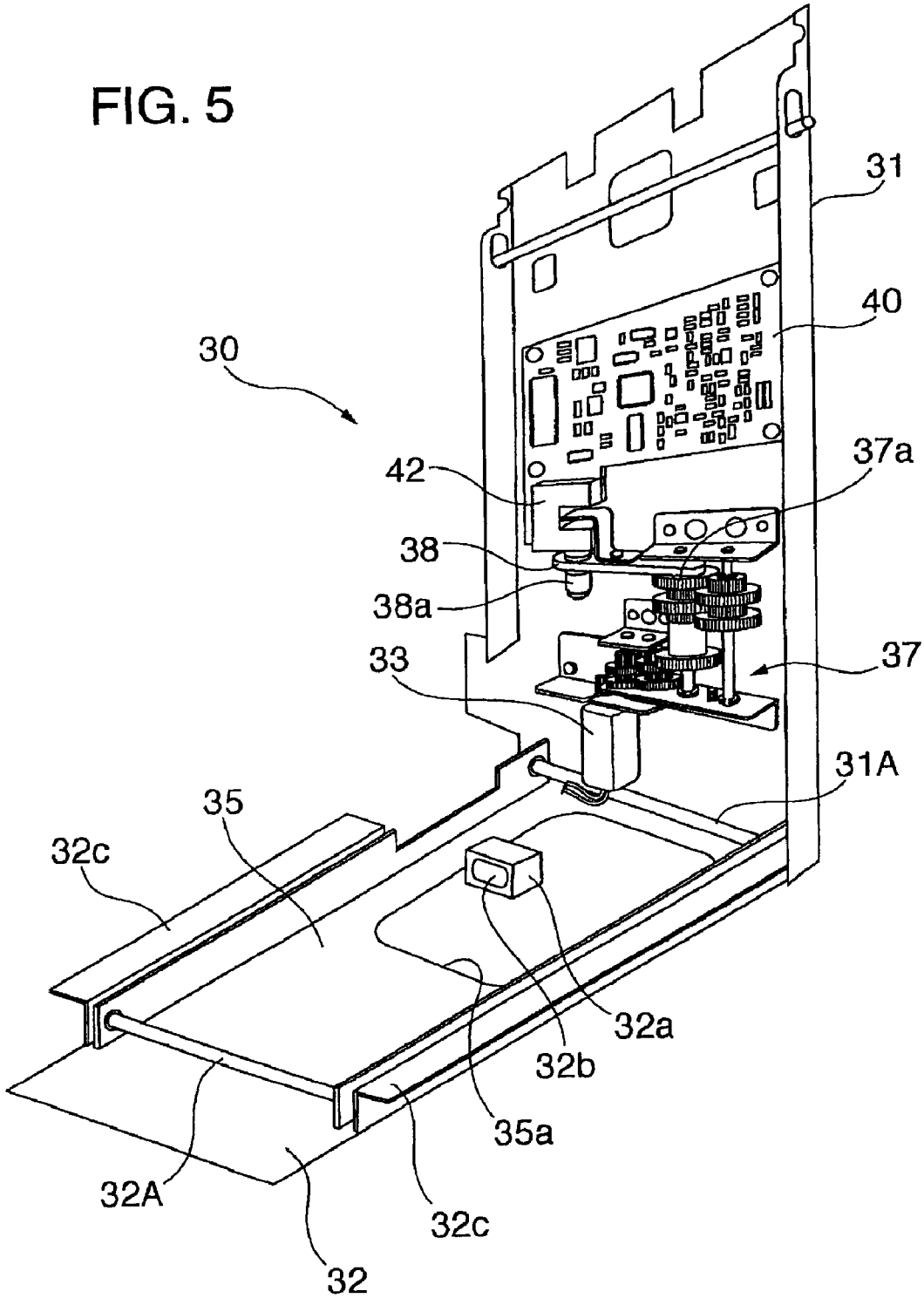
FIG. 5 is a view showing a structure of a bill pressing mechanism, where a pressing plate is opened relative to the cover member.
Figure 6:
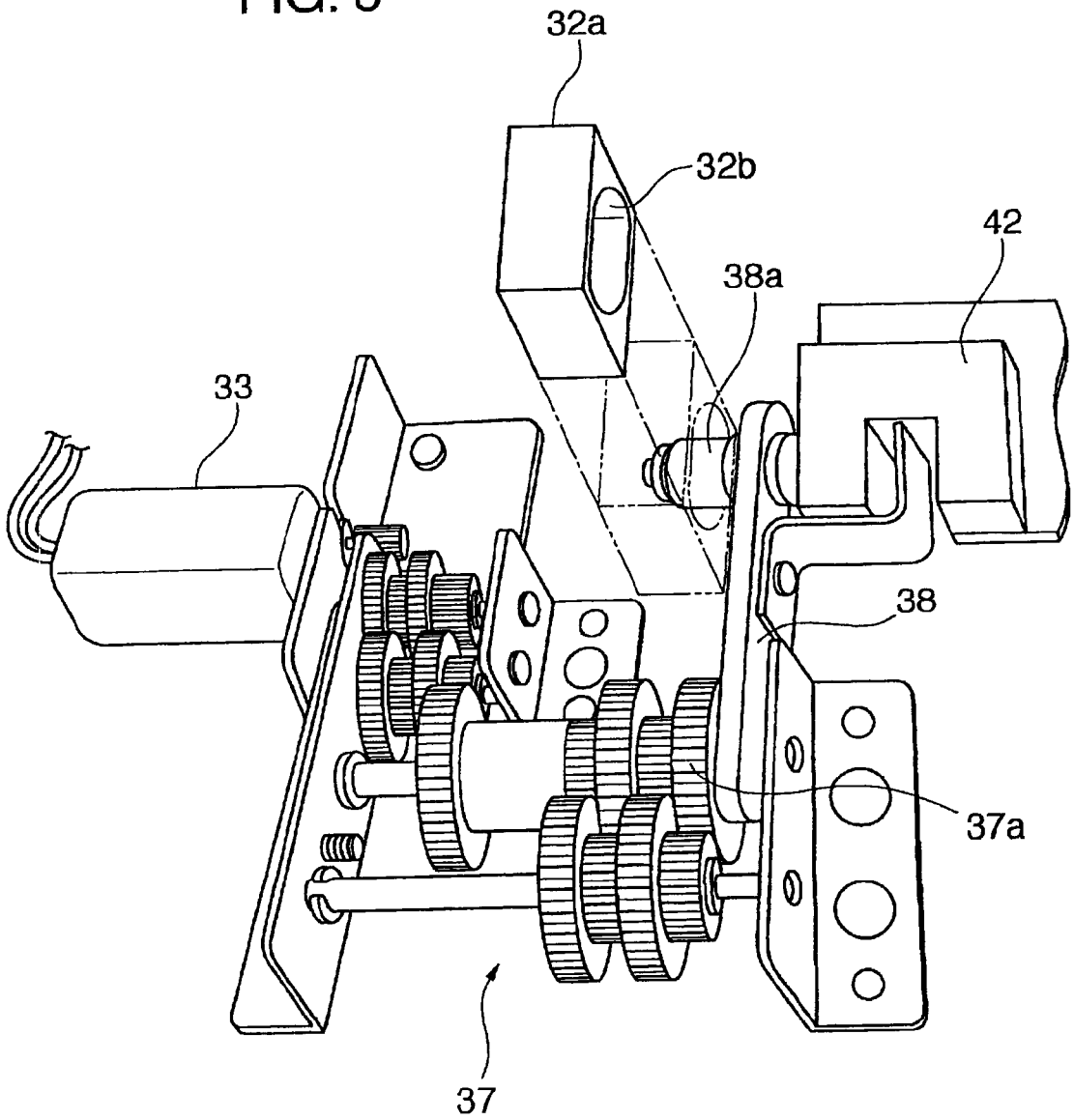
FIG. 6 is a view showing structures of a plate driving motor and a deceleration mechanism of the motor.
Figure 7:
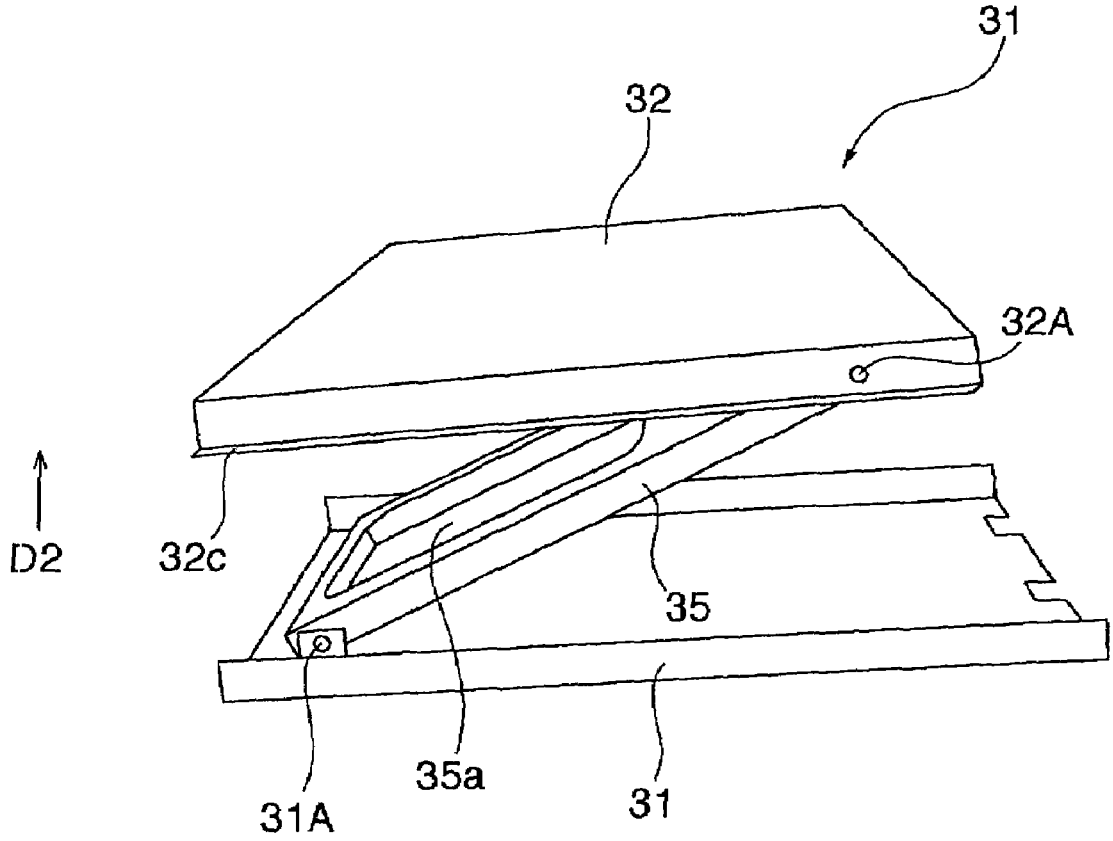
FIG. 7 is a view showing a structure of a link mechanism of the pressing plate to the cover member.
Figure 8A:
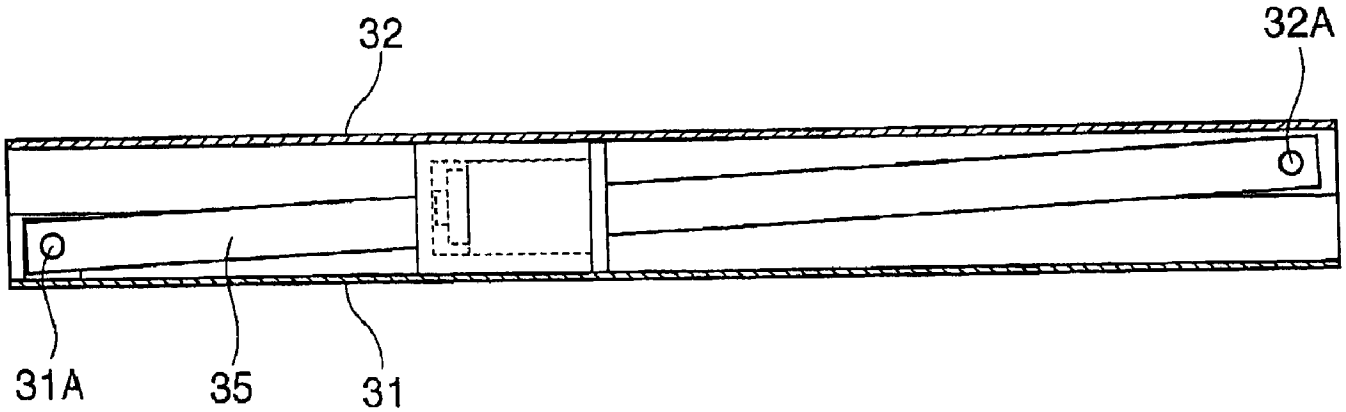
FIG. 8A is a view showing the operation of the pressing plate (non-pressing state)
Figure 8B:
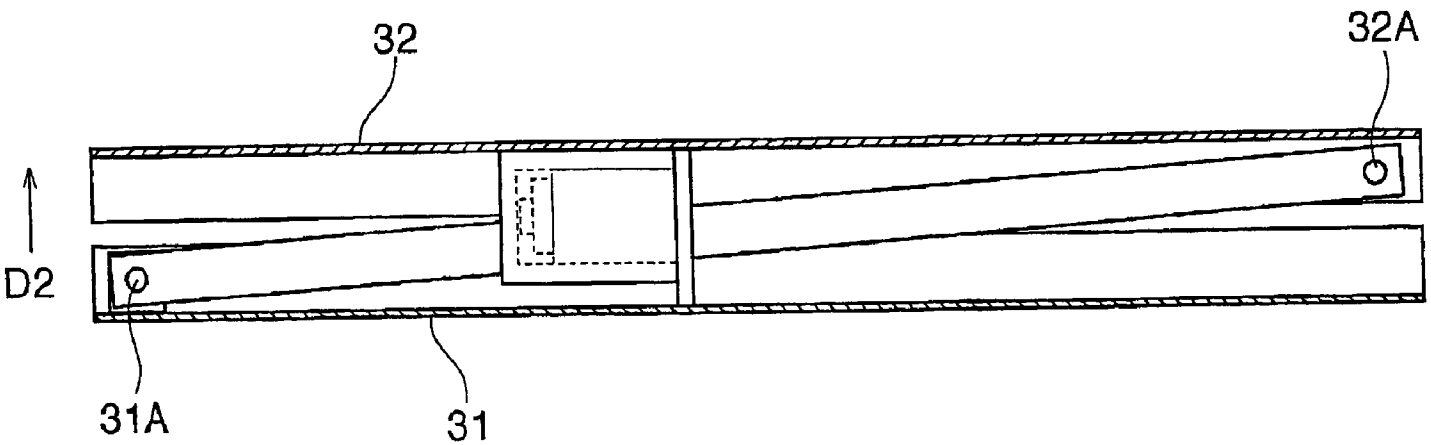
FIG. 8B is another view showing the operation of the pressing plate (pressing state)

A structure of the bill pressing mechanism 30 will be described below with reference to FIGS. 5 to 8C. In addition, in theses figures, FIG. 5 is a view showing a state where the pressing plate is opened relative to the cover member, FIG. 6 is a view showing structures of the plate driving motor and a deceleration mechanism of the motor, FIG. 7 is view showing a structure of a link mechanism of the pressing plate to the cover member, and FIGS. 8A and 8B are views showing the operation of the pressing plate, and respectively show the non-pressing state and pressing state.

The pressing plate 32 has substantially almost the same size as the size of the bill, and is supported by the cover member 31 to be movable toward the direction of the arrow D2 by a link mechanism (a link device; moving means) 35 that couples the backside on one end side of the pressing plate 32 and the backside on the other end side of the cover member 31. The opposite ends of the link mechanism 35 are supported pivotally via spindles 31A, 32A provided in the cover member 31 and pressing plate 32, respectively. By such a link mechanism, the pressing plate 32 is supported to come close and separate to/from the cover member 31 while being parallel with the cover member 31, as shown in FIGS. 7 and 8(8A, 8B).

The plate driving motor 33 is installed on the backside of the cover member 31, and the pressing plate 32 is driven to reciprocate in the direction of the arrow D2 by the plate driving motor 33 being rotary-driven.

Further, on the backside of the cover member 31 are provided a deceleration mechanism (gear train) 37 that conveys the rotary-driving of the plate driving motor 33 to the pressing plate 32 side, and a rotatable push-down arm 38 rotary-driven by a final gear 37*a* of the deceleration mechanism 37. The push-down arm 38 is provided at its rear end portion with the final gear 37*a* and whereby rotary-driven about the rear end portion, while being provided at its front end portion with an engaging protrusion 38*a*. The engaging protrusion 38*a* engages in a long groove 32*b* formed in a protrusion member 32*a* attached to the backside of the pressing plate 32. The pressing plate 32 is driven to reciprocate along the direction of the arrow D2 by the push-down arm 38 being rotary-driven about the rear end portion. In addition, as shown in FIG. 5, the protrusion member 32*a* is exposed via an opening 35*a* formed in the link mechanism 35, and thus installed not to interfere with the operation of the link mechanism 35.

The pressing plate 32 has a shape for vertically drooping (protruding) toward the pressing direction by a predetermined distance, and has flanges (extensions; abutting means) 32*c* formed at opposite sides in the longitudinal direction. By this means, the pressing plate 32 is configured to enter the opening of the mount tray 60 described later when driven in the push-down direction by the push-down arm 38, while being prevented from entering any more when entering the opening to some extent, by the both flanges 32*c* coming into contact with the engage portions (engage means) 61*c* of the mount tray 60 described later. In other words, by providing such flanges 32*c*, the pressing plate 32 is capable of applying the uniform pressing force to the bill in the longitudinal direction, although its one side is supported by the link mechanism 35.

Further, in this embodiment, to the backside of the cover member 31 is attached a control board (constituting the control means) 40 that controls the driving of various driving mechanisms in the bill handling device 1. The control circuit board 40 is connected to an optical sensor (rotation detecting sensor) 42 that detects an amount of rotation of the push-down arm 38, and when the amount of rotation of the push-down arm 38 i.e. a push-down amount of the pressing plate 32 becomes a predetermined state, controls to halt the driving of the plate driving motor 33. Thus, the plate driving motor 33 is prevented from undergoing the action of unnecessary load.

As shown in FIGS. 2 and 3, the mount tray 60 is provided on the other side of the casing for the bill push-in region 10. The mount tray 60 is configured to successively stack and store bills pressed by the pressing plate 32. A structure of the mount tray will be described below with reference to FIGS. 9 (9A, 9B) and 10 (10A-10C).

The mount tray 60 has a main body 61 provided with a bottom wall 61*a* and side walls 61*b* formed at opposite sides of the bottom wall 61*a*.

Figure 9A:
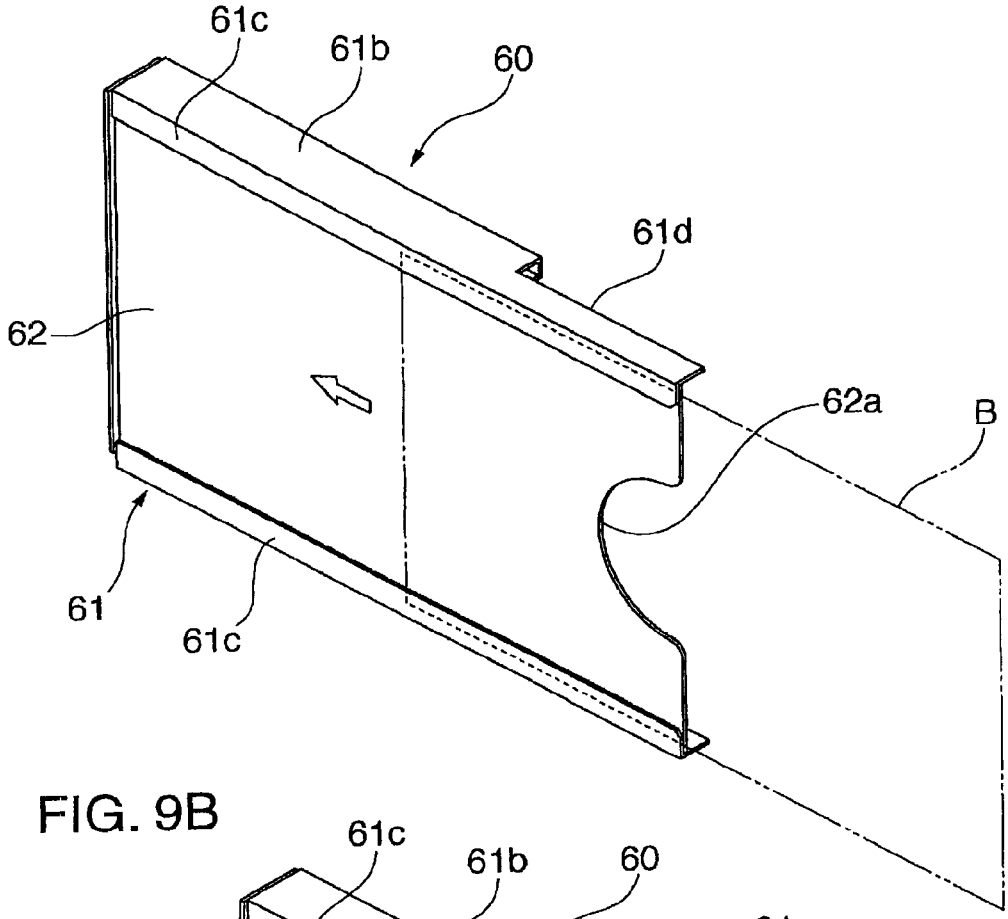
FIG. 9A is a perspective view showing a structure of a mount tray with a bill ejected to a bill push-in region.
Figure 9B:
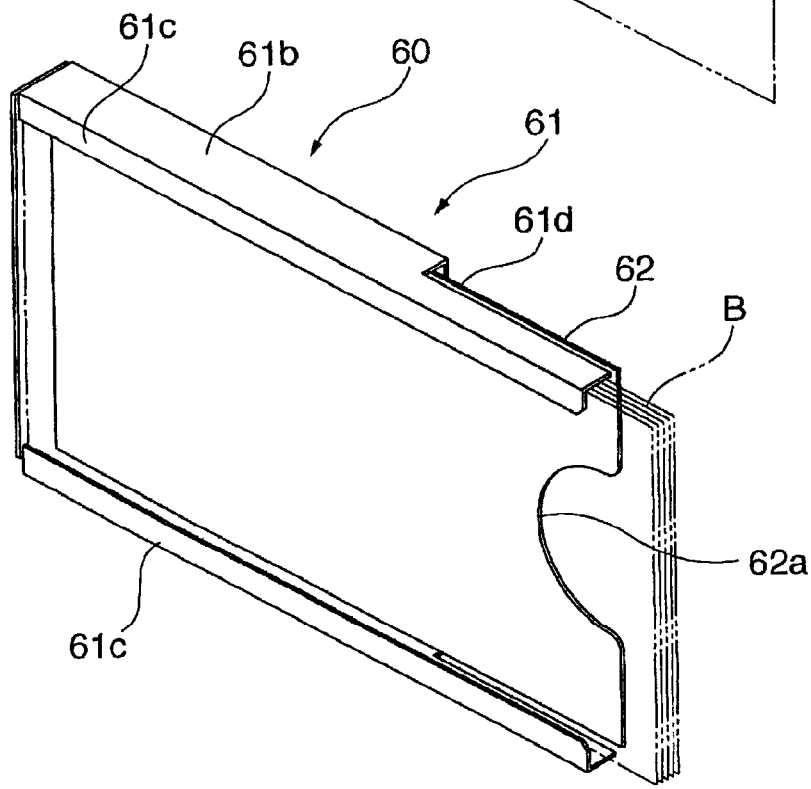
FIG. 9B is a perspective view showing a structure of the mount tray with bills stacked and stored.
Figure 10A:
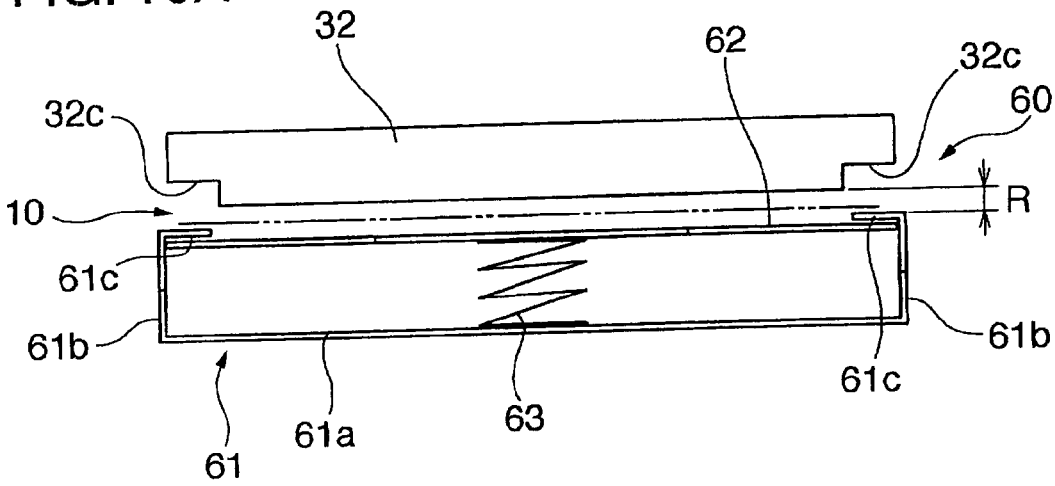
FIG. 10A is a view to explain a state before the pushing plate pushes a bill toward the mount tray.
Figure 10B:
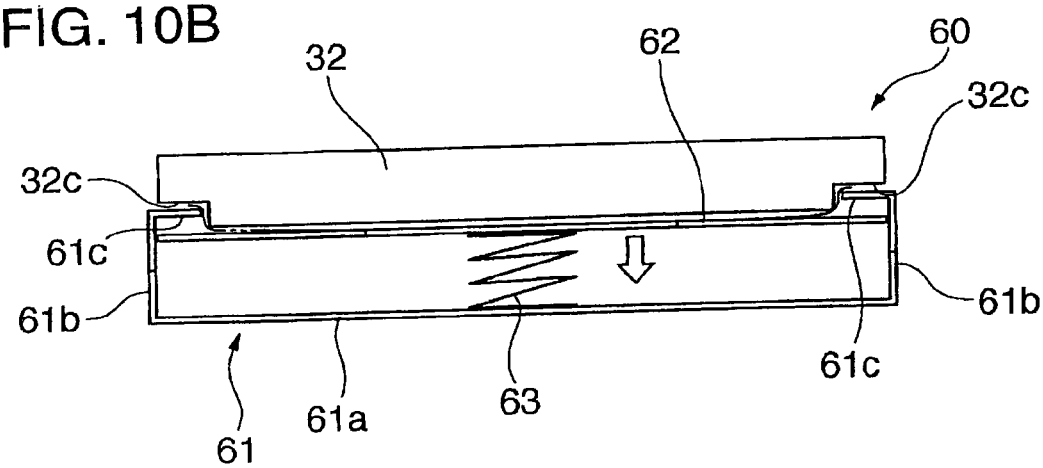
FIG. 10B is a view to explain a state where the pushing plate is pushing the bill toward the mount tray.
Figure 10C:
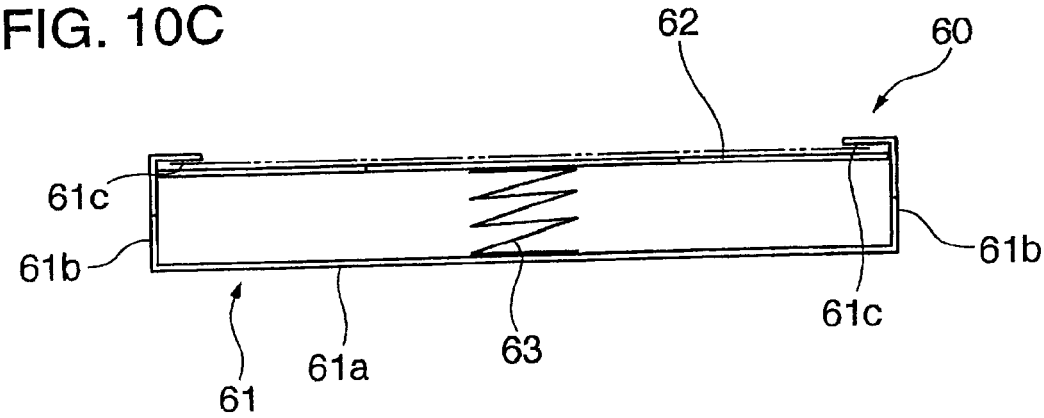
FIG. 10C is a view to explain a state after the pushing plate pushes the bill toward the mount tray.

A mount plate (a bill mount portion) 62 on which a bundle of bills is mounted is provided between the opposite walls 61*b* of the main body 61, and given force to be pressed by a force-applying spring (urging spring; urging means) 63 installed between the plate 62 and bottom wall 61*a* of the main body 61. A pair of engage portions 61*c* extending along the longitudinal direction of a bill to be stored are formed at end portions on the opening side of both of the side walls 61*b*. The engage portions 61*c* have the function of making a separation between a bill ejected to the bill push-in region 10 via the bill feeding mechanism 7 and a bundle of bills stored inside the main body 61, as shown in FIGS. 9A and 10A. In other words, when the bill ejected to the bill push-in region 10 is pressed by the pressing plate 32, as shown in FIG. 10B, the bill is carried onto the mount plate 62 while sagging in the center by the engage portions 61*c*, and after getting over the engage portions 61*c*, as shown in FIGS. 9B and 10C, mounted on the mount plate 62 against the force applied by the force-applying spring 63. Then, when the pressing plate 32 returns to the initial position, a bundle of bills stacked and stored on the mount plate 62 is brought into contact at opposite end portions with the pair of engage portions 61*c* by the force applied by the force-applying spring 63.

By this means, as shown in FIG. 10A, the clearance R is formed between the uppermost bill among bills stacked and stored on the mount plate 62 and the pressing plate 32 and the separation is made. In other words, the bill ejected via the bill feeding mechanism 7 is sent into the clearance R, and the bill sent therein is successively stacked and stored inside the mount tray 60 by the driving of the pressing plate 32 in the initial position.

In addition, too broad clearance R becomes a cause of jam occurring in the case where the bill has wrinkles, while too narrow clearance R fails to stably send the bill. More specifically, a preferable range of the clearance is about 3 to 5 mm, and in the bill push-in region 10, the bill pressing mechanism 30 and mount tray 60 can be disposed to form such a clearance.

The bill to be stacked and stored in the main body 61 of the mount tray 61 is held by the mount plate 62 given the force to be pressed and the engage portions 61*c*, and by such a constitution, a bundle of bills is exposed at the front end side. Therefore, as described later, when the mount tray 60 is driven and the front end side thereof protrudes from the front face 1*b* of the casing 1*a*, the front end portion of the bundle of bills stacked and stored on the mount plate 62 is exposed, and therefore, an operator is capable of easily pulling the bundle of bills toward the front to perform the collecting operation.

In this case, the length of the main body 61 (mount plate 62) in the longitudinal direction (length of the bill mount surface) is formed to be shorter than the length of an inserted bill, as shown in FIG. 9B. When the length of the mount plate 62 is thus shorter, a bundle of bills stacked and stored on the plate 62 is exposed at upper front end and lower front end, and the operator is whereby capable of easily grasping the bundle of bills to pull out. Further, by configuring in such a manner, the operator eliminates the need of touching the mount plate 62 formed of metal such as SUS and the like by finger, and the safety is enhanced at the time of the collecting operation. Alternately, as shown in FIGS. 9A and 9B, a concave portion 62*a* may be formed in the center of a front end edge of the mount plate 62, and also in such a configuration, a bundle of bills is easy to grasp, and the above-mentioned effects and advantages are obtained.

In addition, notch portions (interference preventing means) 61*d* extending in the bill insertion direction are formed on the casing side of the front end side of both side walls 61*b* of the main body 61 over a predetermined range. By forming such notch portions 61*d*, when the shutter is opened by a shutter mechanism and the mount tray 60 is driven in the protrusion direction, the interference between the opened shutter and main body 61 is canceled, and it is possible to effectively obtain the efficient space.

Further, a bill detecting sensor (bill detector; bill detecting means) 128 (see the block diagram in FIG. 15) may be provided in the mount tray 60 to detect the presence of a bill on the mount tray 62.

Figure 11:
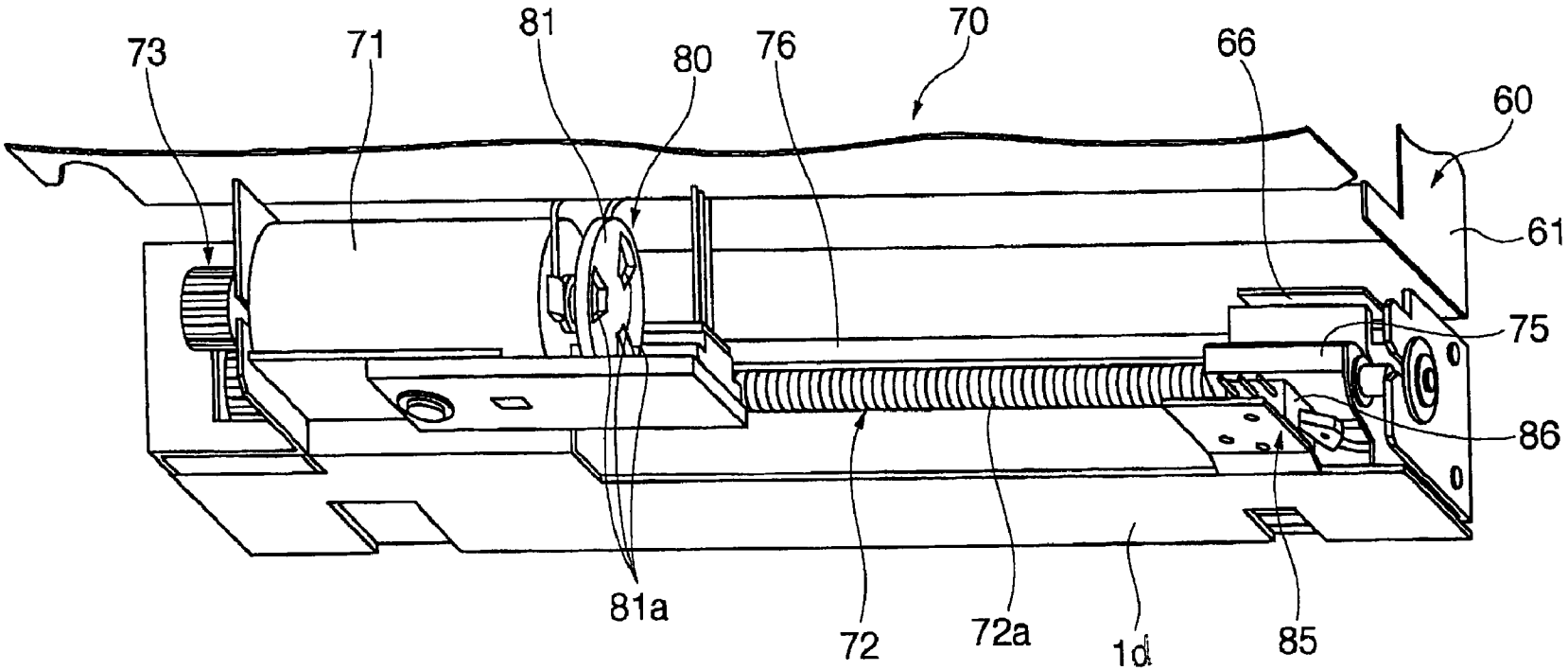
FIG. 11 is a view showing a structure of a mount tray driving mechanism.

Referring to FIGS. 3 and 11, described below is a mount tray driving mechanism for driving the above-mentioned mount tray.

The mount tray driving mechanism 70 is provided with a tray driving motor 71 fixed to the internal frame 1*d* of the casing 1*a*, and a driving shaft (worm shaft) 72 rotary-driven by the tray driving motor 71. The driving shaft 72 is supported rotatably by the internal frame to extend in the bill insertion direction, and provided on the outer circumference surface with a male thread 72*a*. Further, the driving shaft 72 is coupled on one end side to an output axis of the tray driving motor 71 via a gear train 73.

A coupling piece 66 is formed at the rear end portion of the main body 61 of the mount tray 60, and to this portion is coupled a slide member 75 disposed to surround the driving shaft 72. In the slide member 75 is formed a female thread portion (not shown) to screw with the male thread portion 72*a* of the driving shaft 72. By the driving shaft 72 being rotary-driven, the slide member 75 i.e. the mount tray 60 is capable of being driven to reciprocate along the axis direction. In this case, the slide member 75 is inserted into a guide rod 76 disposed in parallel with the driving shaft 72 to restrict its rotation when reciprocating.

Then, the mount tray driving mechanism 70 is provided with shift amount detecting means 80 capable of detecting a shift amount of the mount tray 60. The shift amount detecting means 80 is comprised of, for example, a disk-shaped rotary member 81 attached to a portion of the output axis of the tray driving motor 71 protruding on the opposite side, and a rotation amount detecting sensor (optical sensor) 82 disposed to pinch the rotary member 81 via a clearance. Encoders 81*a* (openings spaced at a predetermined interval along the circumference direction) are formed in the rotary member 81, and when the encoders 81*a* rotate in synchronization with the rotation of the tray driving motor 71, the rotation amount detecting sensor 82 is capable of obtaining pulses corresponding to the rotation amount, and corresponding to the number of pulses, recognizing the shift amount of the mount tray 60.

By providing such shift amount detecting means 80, it is made possible to accurately control a stop position in the protrusion direction of the mount tray 60, and reduce the load on the tray driving motor 70.

Further, the mount tray driving mechanism 70 is further provided with position detecting means 85 capable of detecting a storage position (that enables a bill to be accommodated: accommodation position) of the mount tray 60. Such position detecting means 85 is constructed by, for example, providing a latch piece (not shown) in the slide member 75 for driving the mount tray 60, and attaching a limit switch 86, which is switched on and off by the latch piece contacting and separating, to the internal frame 1*d*.

By providing such position detecting means 85, it is made possible to recognize a state of the mount tray 60 (whether the tray is in the storage position or collection position), and the mount tray 60 can be driven suitably at the time of bill collecting operation.

Bills stacked and stored on the mount tray 60 can be collected by open-driving the shutter mechanism 90 disposed adjacent to the bill insertion slot 3A in the bill handling region 3. A structure of the shutter mechanism will be described below with reference to FIGS. 2, 3 and 12 to 14B.

The shutter mechanism 90 has a shutter (shield plate) 91 that closes a rectangular opening formed in the bill handling region, and a shutter driving mechanism 92 that rotary-drives the shutter 91. The shutter 91 is formed as a substantially rectangular plate member, and rotatably supported at its rear end portion by a spindle 91*a* relative to the internal frame of the casing. The shutter driving mechanism 92 has a shutter driving motor 95. The shutter driving motor 95 is coupled to the spindle 91*a* via a gear train 96 constituting the deceleration mechanism coupled to a driving shaft 95*a* of the motor 95, and arm-shaped link members 97*a*, 97*b* successively coupled to the gear train 96.

Figure 14A:
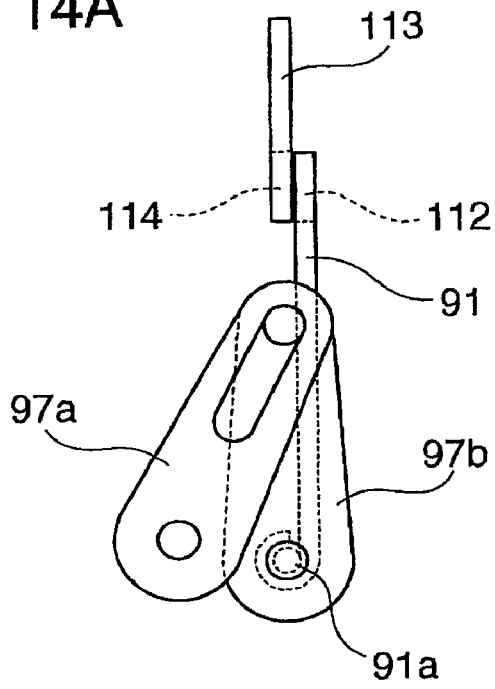
FIG. 14A is a side view showing the shutter mechanism being locked.
Figure 14B:
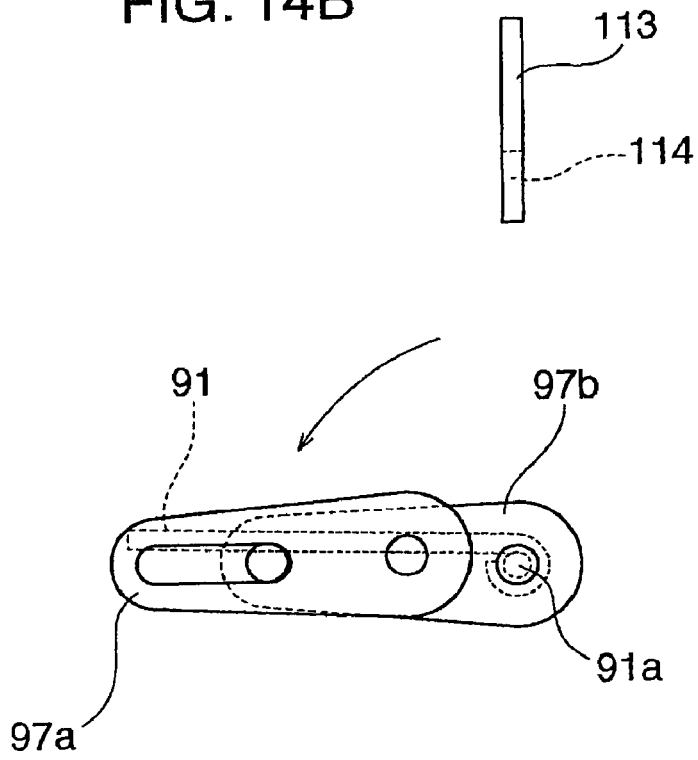
FIG. 14B is a side view showing the shutter mechanism with the lock released.

More specifically, when the shutter driving motor 95 is driven and the driving shaft 95*a* is rotary-driven, the rotary-driving force is decelerated via the gear train 96. A spindle of the link member 97*a* is connected to an output gear 96*a* of the gear train 96, and by driving the shutter driving motor 95 in forward rotation, the link member 97*a* is rotary-driven from the state as shown in FIG. 14A to the state as shown in FIG. 14B. The link member 97*a* is coupled to the other end portion of the link member 97*b* coupled at the rear end portion to the spindle 91*a*. By rotary-driving the link member 97*a* as shown in the figure, the shutter 91 is rotary-driven by substantially 90 degrees from the vertical state toward the inside of the casing via the link member 97*b*.

In addition, the shutter driving mechanism 92 is provided with rotation amount detecting means 100 capable of detecting a rotation amount of the shutter 91. The rotation amount detecting means 100 is comprised of, for example, an encoder 101 formed on the surface of an input gear 96*b* of the gear train 96, and a rotation amount detecting sensor (reflective optical sensor) 102 that detects a rotation amount of the encoder 101.

By providing such rotation amount detecting means 100, it is made possible to accurately control a stop position when the shutter 91 is rotated by approximately 90 degrees, and to reduce the load on the shutter driving motor 95.

Further, in association with the shutter mechanism 90, a lock mechanism (a lock device; lock means) 110 is provided to lock a close state of the shutter 91.

The lock mechanism 110 is comprised of a concavo-convex (a first concavo-convex section) 112 continuously formed at the upper end edge of the shutter 91 driven to open and close, a lock plate 113 movable in the width direction (the direction of the arrow) in the internal frame of the casing, and driving means, for example, solenoid 116 capable of driving the lock plate 113 along the width direction. The lock plate 113 is provided with a concavo-convex (a second concavo-convex section) 114 corresponding to the concavo-convex 112, and always given force by a force-applying spring (urging means) 117 to cause the concavo-convex 112 and 114 not to match (see FIG. 13).

Figure 12:
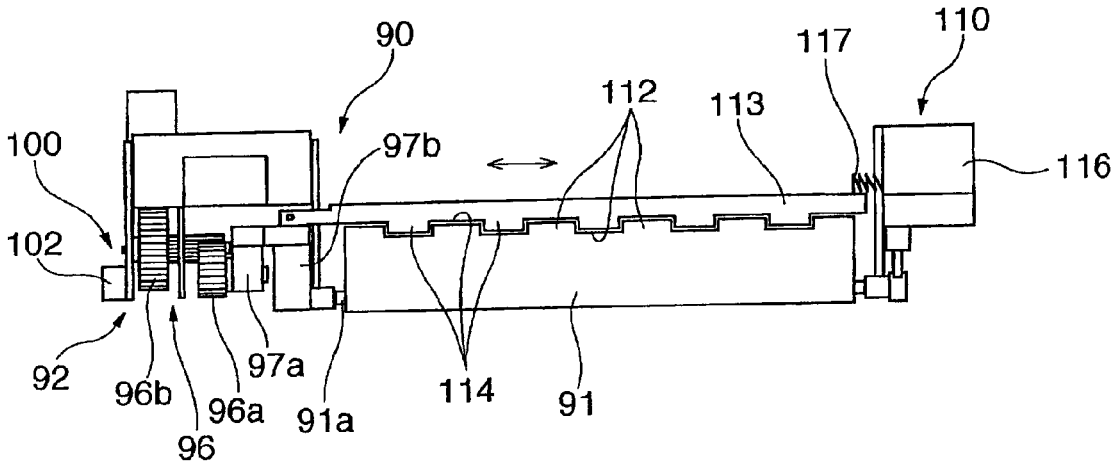
FIG. 12 is a front view showing structures of a shutter mechanism and lock mechanism.
Figure 13:
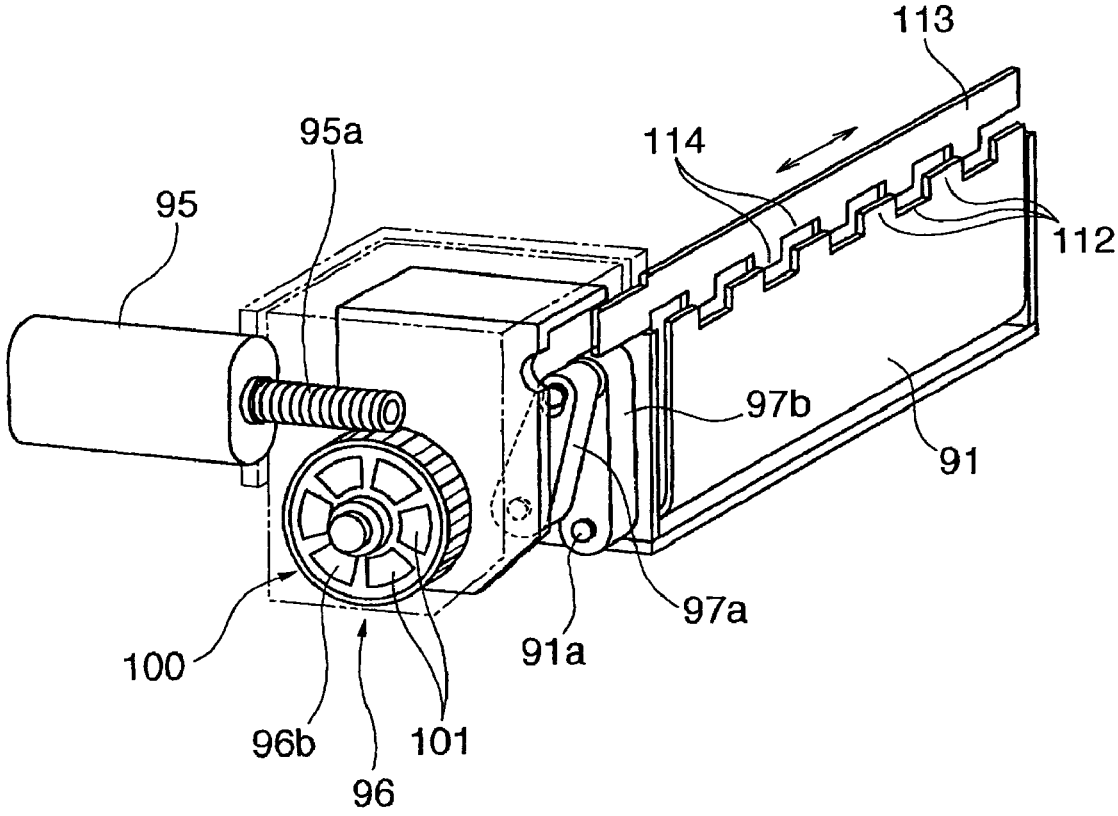
FIG. 13 is a perspective view showing a structure of a shutter driving mechanism.

Then, when bills are collected, by driving the solenoid 116, the lock plate 113 is driven in the width direction against the force applied by the force-applying spring 117 so that the concavo-convex 112 and 114 are matched (see FIG. 12). By this means, the lock state of the shutter 91 is released, and the shutter 91 rotates toward the inside of the casing via the shutter driving mechanism 92 to enable the mount tray 60 to be ejected.

Figure 15:
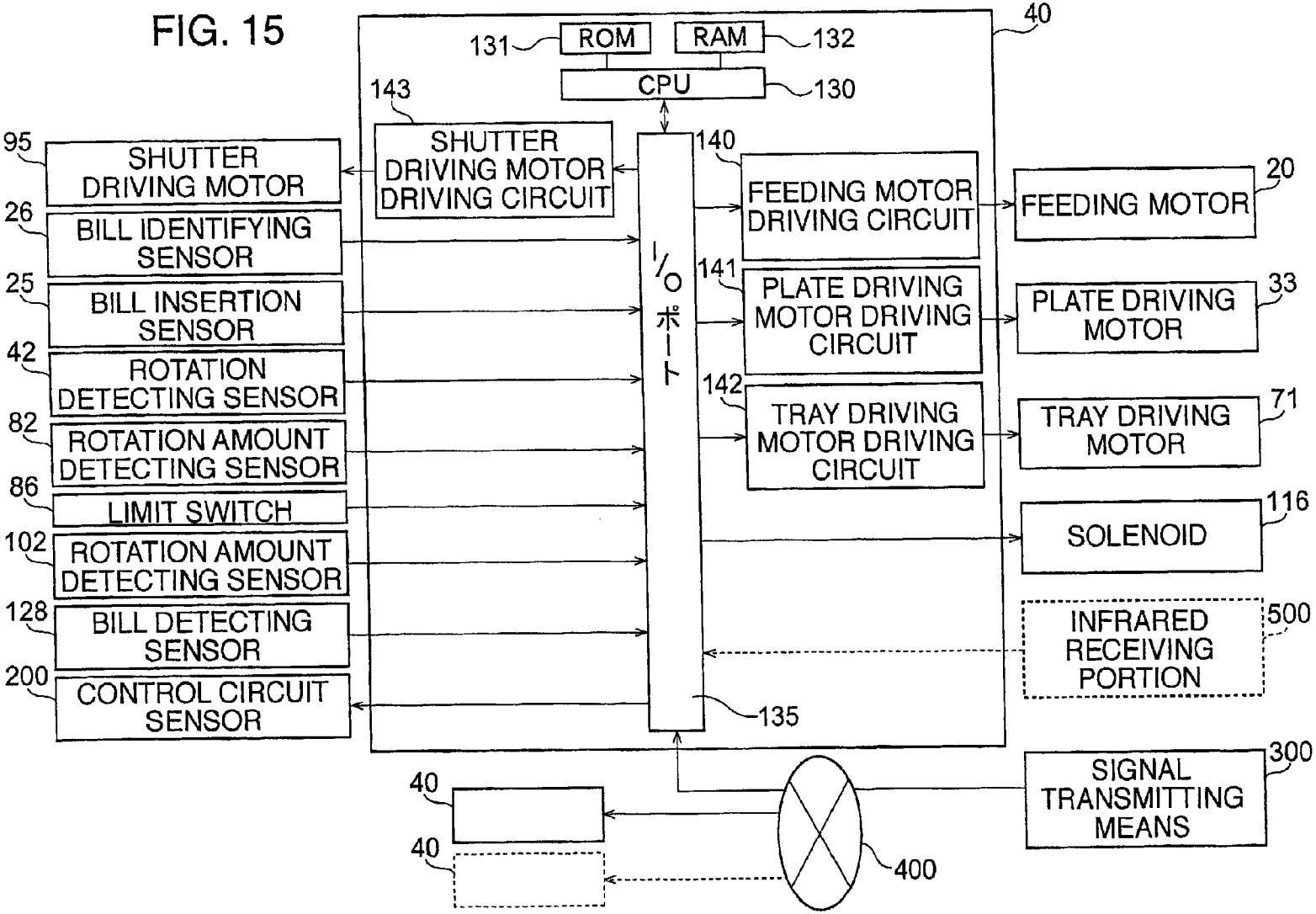
FIG. 15 is a block diagram showing an example of a configuration of control means for controlling the operation of the bill handling device.

FIG. 15 is a block diagram illustrating an example of a configuration of the control means for controlling the operation of the above-mentioned bill handling device 1.

As described above, the control means is provided with the control circuit board 40 that is attached to the backside of the cover member 31 and that controls the operation of each of above-mentioned actuators. The control circuit board 40 is comprised of a CPU 130 having the function of controlling the operation of various driving devices such as the feeding motor 20, plate driving motor 33, tray driving motor 71, shutter driving motor 95, solenoid 116 and the like, ROM 131 that stores operation programs of the various driving devices, detection data on the authorized bills and the like, and control RAM 132.

The CPU 130 is connected via an I/O port 135 to motor driving circuits 140 to 143 that drive above-mentioned various motors. The driving operation (forward rotation, reverse rotation and stop) of each of the driving motors is controlled by a control signal from the CPU 130 according to the operation program. Further, to the CPU 130 are input via the I/O port 135 a signal of detecting insertion of a bill from the bill insertion sensor 25, a detection signal on judgment of the bill from the bill identifying sensor 26, a detection signal on a pressing position of the pressing plate 32 from the rotation detecting sensor 42, a detection signal on a position of the mount tray 60 from the rotation amount detecting sensor 82, a detection signal on whether the mount tray is in the accommodation position or not from the limit switch 86, and a detection signal on a rotation position of the shutter 91 from the rotation amount detecting sensor 102. Based on the detection signals, the driving is controlled of the feeding motor 20, plate driving motor 33, tray driving motor 71, shutter driving motor 95, and solenoid 116.

The CPU 130 is further connected to a control circuit 200 that is disposed in the game machine body not shown and that executes the game processing, and transmits game value information corresponding to the amount of an inserted bill to the game machine side.

Moreover, a release signal to release the lock state (drive the solenoid 116) in the lock mechanism 110 is input to the CPU 130 of the control circuit board 40. For example, signal transmitting means 300 for transmitting the release signal is connected via a communication network 400, and can be configured as a part of the function of a management server that manages bank facilities, and it is thus possible to collectively drive and release shutters of bill handling devices in the bank facilities at the work time for collection, for example.

Described next is the operation of the bill handling device 1 with the above-mentioned structure.

Described first are procedures for successively stack and store bills on the mount tray 60.

As shown in FIGS. 1 to 4, when a bill B is inserted into the bill insertion slot 3A while letting the bill B stand with the short sides standing vertically, the bill insertion sensor 25 detects the insertion. When the bill insertion sensor 25 detects the insertion of the bill, the feeding motor 20 is driven in forward rotation, and the bill B is fed inside the casing while being pinched by the feeding belts 17*a*, 17*b* respectively wound around the tension rollers 18*a*, 18*b* and tension rollers 19*a*, 19*b*, and pinch rollers 21*a*, 21*b* and pinch rollers 22*a*, 22*b* in contact with respective tension rollers.

When the bill B is fed to the inside of the casing, the bill identifying sensor 26 detects the bill, and the above-mentioned control means judges the validity of the bill. In this case, when the bill identifying sensor 26 cannot judge the validity of the bill B, the feeding motor 20 is driven in reverse rotation, and the bill B being fed undergoes the sending back action, and is ejected from the bill insertion slot 3A.

Meanwhile, when the bill B is judged as being valid, the feeding motor 20 is driven to rotate until the rear end of the bill B has passed through the nip portion N2 between the tension rollers 18*a*, 18*b* and pinch rollers 22*a*, 22*b*. At this point, as shown in FIGS. 9A and 10A, the bill B is ejected to the inside of the clearance R between the pressing plane of the pressing plate 32 in the bill push-in region 10 positioned downstream of the tension rollers 19*a*, 19*b* and pinch rollers 22*a*, 22*b* and the plane including the engage portions 61 of the mount tray 60. In addition, the clearance is set in a range such that a jam and the like do not occur, and when necessary, a guide (not shown) may be provided downstream of the nip portion N2 to facilitate moving of the bill to the clearance R.

In the stage that the rear end of the bill has passed through the nip portion N2, the forward-rotation driving of the feeding motor 20 is halted, and the plate driving motor 33 is rotary-driven. By this means, the pressing plate 32 is driven in the push-down direction by the push-down arm 38, and presses the bill by its lower plane (see FIG. 10B). Then, the bill pressed by the pressing plate 32 gets over a pair of engage portions 61*c* of the mount tray 60, and is pressed on the mount plate 62 against the force applied by the force-applying spring 63. The pressing force of the pressing plate 32 in the bill direction varies with the support position of the link mechanism 35, but the substantially equal pressing force is acted on the bill along the longitudinal direction, by the flanges (extensions) 32*c* formed at both sides of the pressing plate 32 coming into contact with the engage portions 61*c*. In other words, the plate 32 is capable of evenly holding down the entire bill, and it is thus possible to accommodate a predetermined number of bills reliably even when the bill is bent and/or the bill becomes firmer (as the number of stacked bills increases). In addition, the position of the push-down arm 38 is detected by the rotation detecting sensor 42, and when the arm is in an appropriate position (the flanges 32*c* of the pressing plate 32 are brought into contact with the engage portions 61*c*), the driving of the plate driving motor 33 is halted.

Then, after the pressing plate 32 is given the predetermined pressing force and the flanges (extensions) 32*c* are brought into contact with the engage portions 61*c*, the plate driving motor 33 is driven in reverse rotation, and the pressing plate 32 is returned to the initial position. At this point, the mount plate 62 is acted upon by the force applied by the force-applying spring 63 toward the engage portions 61*c* side, and the uppermost bill is brought into contact with the engage portions 61*c* as shown in FIG. 10C, and thus is separated from a bill to be inserted next.

Subsequently, the above-mentioned operation is repeated, whereby bills are stably stacked and stored on the mount plate 62 of the mount tray 60.

Described next are procedures for collecting bills accommodated in the mount tray 60.

At the time of collecting the bills, for example, the management server (signal transmitting means 300) that manages the entire hall transmits a signal for releasing the lock mechanism 110 to each bill handling device 1 installed in the bank. In this case, for example, the management server may control to release lock mechanisms of bill handling devices in the entire bank, or may control to release lock mechanisms of bill handling devices in a line of the bank. When the bill handling device receives the release signal, the solenoid 116 is driven, and the lock plate 113 is driven in the width direction against the force applied by the force-applying spring 117. By this means, the concavo-convex 114 of the lock plate 113 accords with the concavo-convex 112 formed in the shutter 91, and by rotary-driving the shutter driving motor 95 in this state, the shutter 91 is opened (see FIG. 14B). In addition, the rotation amount of the shutter driving motor 95 is detected by the rotation amount detecting sensor 102, and the driving of the motor 95 is halted when the shutter is in the appropriate position (where the shutter falls by substantially 90 degrees).

When the driving of the shutter driving motor 95 is halted, the tray driving motor 71 is rotary-driven, and the mount tray 60 is ejected on the front end side from the front face of the casing. As described above, since the notch portions 61*d* are formed at both side walls 61*b* of the main body 61 of the mount tray 60, the tray 60 does not interfere with the falling shutter 91, and the front end is ejected. In addition, the rotation amount of the tray driving motor 71 is detected by the rotation amount detecting sensor 82, and the mount tray 60 is halted in an appropriate position.

Figure 16:
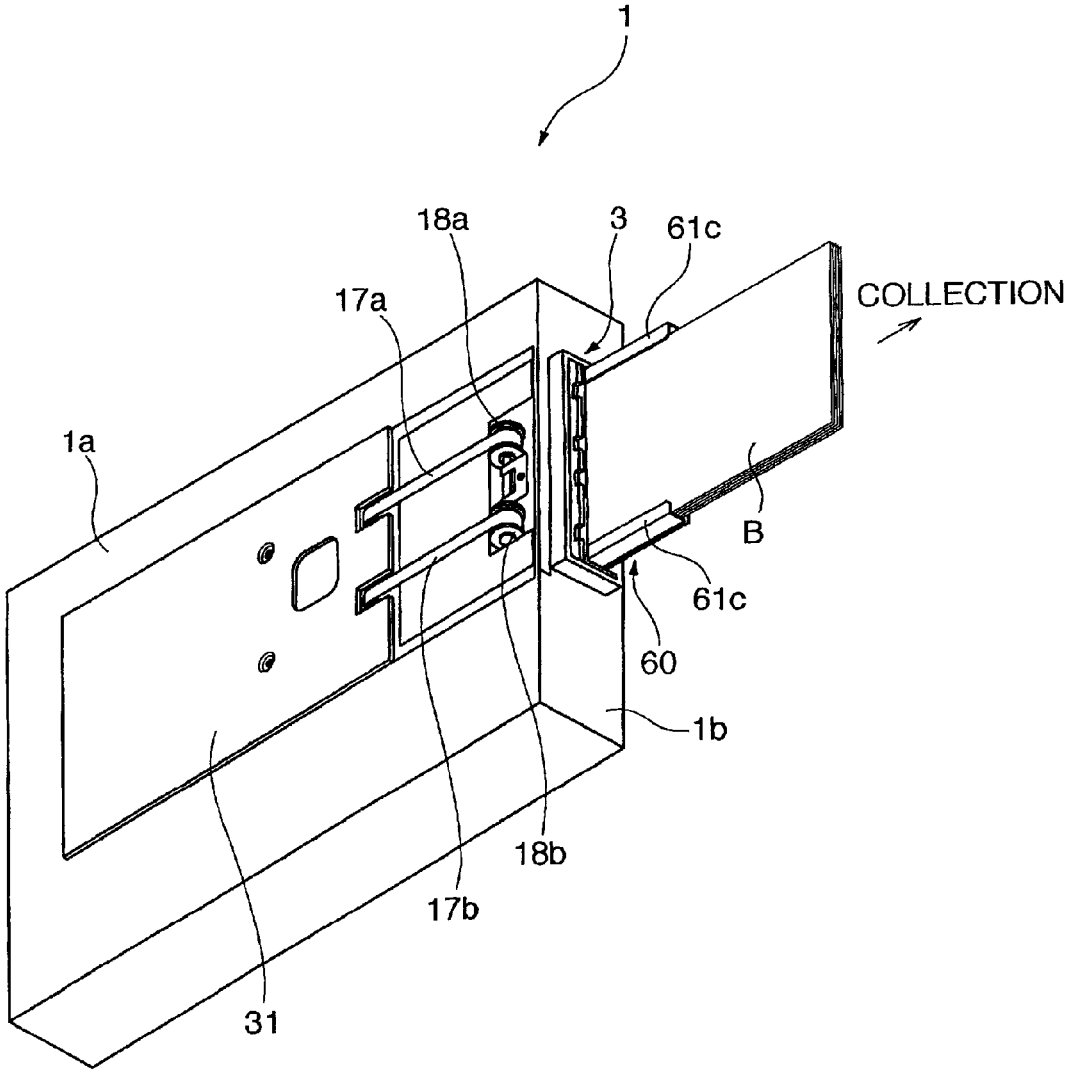
FIG. 16 is a view showing a state where the mount tray is ejected.

When the driving of the mount tray 60 is halted, a bundle of bills mounted on the mount plate 62 is held while being exposed on the front end side as shown in FIG. 16, and therefore, an operator is capable of grasping the exposed bundle of bills to pull out without change, and thus, efficiently performing the operation for collecting bills. Particularly, in this embodiment, as shown in FIGS. 9A and 9B, the length of the mount plate 62 to mount bills is formed shorter than the length of the bill, and further, the concave portion 62*a* is formed in the center of the front end edge of the mount plate 62. Therefore, when the mount tray 60 protrudes, it is made possible to easily pick up the front end portion of a bundle of bills stacked and stored, and the operation for collecting the bill is made easy to perform.

Then, at the time of bill collecting operation, when the bill detecting sensor 128 detects that no bill exists on the mount plate 62 (when the collecting operation is finished), the processing is executed that is inverse to the above-mentioned processing procedures after a lapse of predetermined time. In other words, the tray driving motor 71 is driven in reverse rotation, and the mount tray 60 is returned to the accommodation position. In the stage that the limit switch 86 detects the presence of the mount tray 60, the shutter driving motor 95 is driven in reverse rotation to turn the shutter 91 to the closed state. Subsequently, by canceling the force of the solenoid 116, the lock plate 113 is returned to the initial position, and the lock mechanism 110 is activated.

The lock mechanism 110 is thus activated automatically when detecting that any bills are not present on the mount plate 62. Therefore, the operator is only required to perform the bill collecting operation without any need to perform other operations, and is capable of performing the bill collecting operation with high efficiency. Further, according to such a constitution, omission (human error) of lock of the shutter 91 is reliably prevented in the bill collecting operation, and security is whereby enhanced. In addition, the above-mentioned control means may be configured not to release the lock mechanism when a bill is not present on the mount plate 62 in receiving a signal to release the lock mechanism. In other words, in a state where a bill is not present, the lock mechanism remains maintained without driving the mount tray 60, and it is whereby possible to reliably prevent the lock from being omitted and the like.

In addition, the release of the lock mechanism 110 may be performed by a dedicated portable terminal that the operator possesses. For example, each bill handling device may be provided with an infrared receiving portion 500 (see FIGS. 1 and 15), and release the lock mechanism 110 when receiving a predetermined lock release signal from the portable terminal via the infrared receiving portion. In other words, according to such a constitution, it is possible to release the lock mechanism to perform the collecting operation individually on a large number of bill handling devices. Alternately, such a release operation may be performed collectively by the portable terminal via the management server. In other words, lock mechanisms may be released collectively for the entire bank or for each line of the bank by the operation of the portable terminal.

According to the bill handling device configured as described above, various structural members are efficiently disposed in the limited installation space, whereby making the device compact, and further, it is possible to perform the bill collecting operation efficiently.

In other words, in the bill handling device with the above-mentioned constitution, a bill inserted into the bill insertion slot 3A is fed without change by the bill feeding mechanism 7, and ejected toward the clearance R of the bill push-in region 10 positioned downstream of the mechanism 7. Since the bill push-in region 10 is not provided with any feeding mechanism (feeding rollers and the like) to feed the bill toward the insertion direction, the space can be acquired in the width direction of the casing 1*a*, and it is made possible to efficiently install the bill pressing mechanism 30 and mount tray 60 to stack and store bills in the width direction in this region.

Further, as shown in FIG. 4, the distance between the pinch rollers is set to be shorter than the distance between the tension rollers, a position of installation of the pinch roller is provided with an offset in the direction perpendicular to the bill feeding direction, and in this perpendicular direction, the space can be reduced.

The foregoing will more specifically be described with reference to FIGS. 17A to 17C.

Figure 17A:
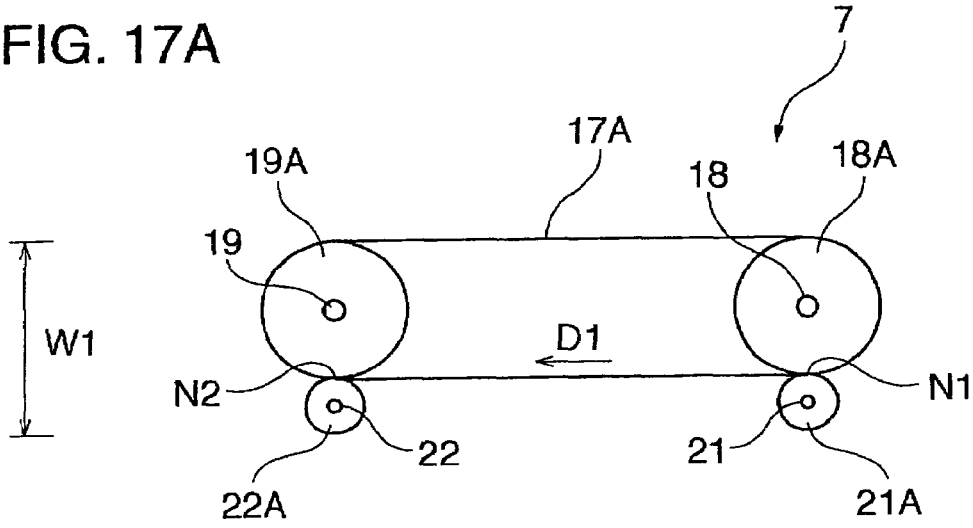
FIG. 17A is a view showing a structure of a typical bill feeding mechanism.
Figure 17B:
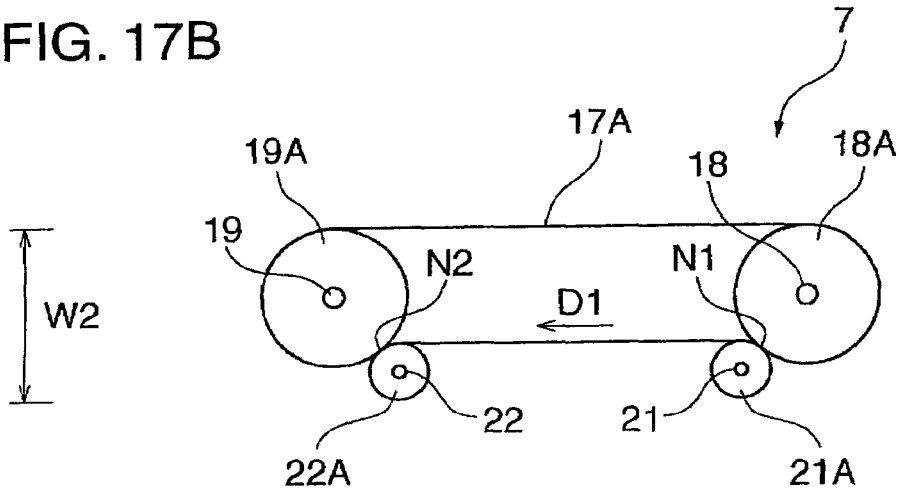
FIG. 17B is a view showing a structure of a bill feeding mechanism according to the invention.

As shown in FIG. 17A, when the distance between the tension rollers 18A and 19A is set to be equal to the distance between the pinch rollers 21A and 22A, and the pinch rollers 21A and 22A are respectively brought into press-contact with the tension rollers 18A and 19A around which a feeding belt 17A is wound in the direction perpendicular to the bill insertion direction D1, a region shown by W1 in the figure is required for the installation space of the feeding mechanism 7. In contrast thereto, as shown in FIG. 17B, the pinch rollers 21A and 22A are set to contact the tension rollers 18A and 19A in positions such that the distance between the rollers 21A and 22A is shorter than the distance between the tension rollers 18A and 19A, and whereby provided with an offset in the direction perpendicular to the bill insertion direction D1, whereby corresponding to the offset, the space of the feeding mechanism 7 is reduced. In other words, the installation space can be a region shown by W2 smaller than W1.

Figure 17C:
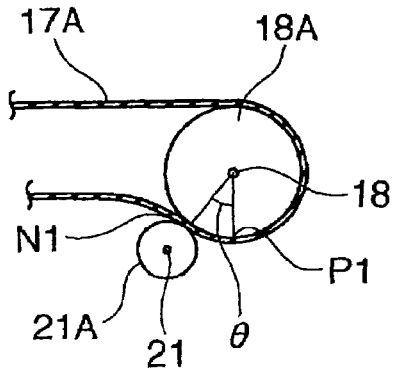
FIG. 17C is a view showing the feeding belt wound around a tension roller of FIG. 17B.

Further, as shown in FIG. 17C, since the feeding belt 17A wound around the tension rollers 18A and 19A is given the tension in arch-shape by the contact of the pinch rollers 21A and 22A, the need is eliminated of installing force applying means in the pinch roller portion, and corresponding to the eliminated need, the space is reduced, while the construction is simplified (the figure shows the tension roller 18A side, and the tension is given in the range of an angle .theta. from the lowest point P1 of the tension roller 18A to the nip portion N1.)

Furthermore, as described above, since the feeding belt 17A is given the tension in arch-shape, even when a fed bill has curl (wrinkles, buckling and bending), the bill undergoes the correction action in passing through the portion, and it is possible to resolve the curl of the bill. In other words, as compared with the construction such that the tension portion of the feeding belt 17A is of point contact as shown in FIG. 17A, the effect of correcting wrinkles of the bill is enhanced.

Figure 18A:
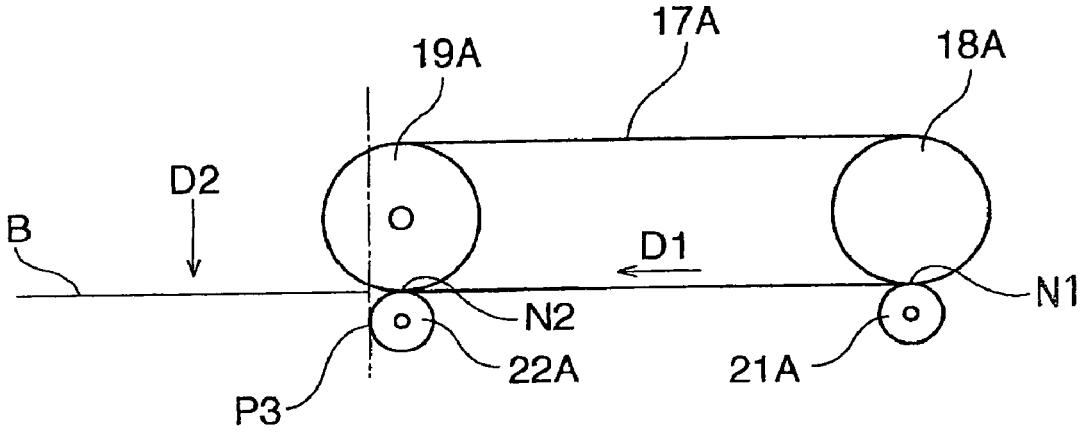
FIG. 18A is another view showing the structure of the typical bill feeding mechanism.
Figure 18B:
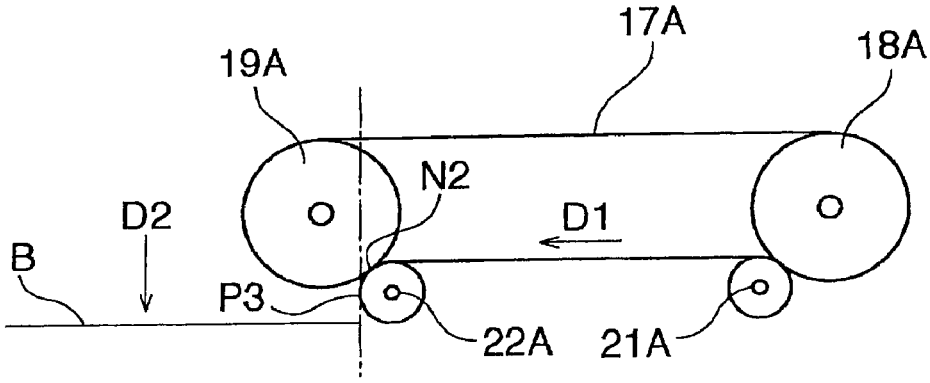
FIG. 18B is another view showing the structure of the bill feeding mechanism according to the invention.

Moreover, as shown in FIG. 18B, on the downstream side in the bill feeding direction D1, the nip portion N2 between the tension roller 19A and pinch roller 22A can be provided with an offset toward the upstream, and it is thus possible to install the handling mechanism (bill pressing mechanism) for handling an ejected bill as close to the bill insertion slot as possible, and to reduce the space in the bill feeding direction. In other words, as can be seen from comparison with FIG. 18A, considering position P3 on the periphery that is the rearmost end of the pinch roller 22A, as shown in FIG. 18B, the position is provided with an offset to the upstream side as compared with the construction shown in FIG. 18A, the bill pressing region toward the direction D2 can whereby be shifted to the upstream side, and as a result, it is possible to dispose the bill pressing mechanism 30 close to the feeding mechanism 7 side, and implement reduction in space in the bill feeding direction.

Further, the separation between the mount tray 60 and a fed bill is made simply by the engage portions 61*c* for separation formed in the mount tray 60, the construction is whereby simplified, and it is possible to effectively use the space inside the casing. In other words, by simply providing the mount tray 60 with the engage portions 61*c* with which opposite edge portions of the bill come into contact, while the bill push-in region 10 is formed between the tray 60 and pressing plate 32, separation between the tray and the bill ejected to the bill push-in region is made easily. As a result, it is possible to dispose the mount tray 60 and bill pressing mechanism 30 adjacent to each other in the width direction, efficiently ensure installation space for the tray 60 and mechanism 30, and acquire adequate space for stacking bills.

Furthermore, in the above-mentioned constitution, since various driving mechanisms are disposed inside the casing, wiring space is required for coupling the various driving mechanisms, control circuit board and external apparatus. In this case, by forming a pattern of signal lines and communication lines on the sensor board 5A installed between both side walls of the casing, the wiring can be omitted, and it is possible to make the internal space efficient and reduce the size of the entire device.

Then, the mount tray 60, on which bills are stacked and mounted successively from the bill push-in region 10 by the bill pressing mechanism 30, protrudes on the front end side from the front face of the casing 1*a* by the mount tray driving mechanism 70. At this point, a bundle of bills stacked and stored on the mount tray 60 is held while being exposed on the front end side, and therefore, an operator is capable of pulling out the exposed bundle of bills from the front, and thus, efficiently performing the operation for collecting bills. In this case, since a bundle of bills is reliably held by the engage portions 61*c* of the mount tray 60 and mount plate 62, such an inconvenience does not occur that bills are left inside the casing at the time of collecting operation.

While the embodiment of the present invention is explained in the foregoing, the present invention is characterized by a mode of arrangement of the tension rollers and pinch rollers in contact with the tension rollers in the bill feeding mechanism, and in that a bill ejected to the bill push-in region is pushed in the direction perpendicular to the bill feeding direction. Structural members such as various driving mechanisms and the like disposed inside the casing are illustrated only as examples, and specific structures thereof are capable of being modified as appropriate when allowed to perform the same processing and operation.

The bill handling device of the present invention is capable of being installed in various devices that handle bills, for example, outside apparatuses such as various vending machines, as well as being installed between various game machines.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A bill handling device comprising:

a bill insertion slot into which a bill is inserted;

a pair of tension rollers provided respectively on an upstream side where the bill is inserted and on a downstream side where the bill is ejected, the tension rollers being mounted to a rotatable support shaft;

a feeding belt wound around the tension rollers, the feeding belt for feeding the bill inserted from the bill insertion slot;

a pair of pinch rollers disposed between the tension rollers on the upstream side and the downstream side, the pinch rollers making up respectively nip portions on the upstream side and the downstream side, the pinch rollers being in contact with the tension rollers while pinching the feeding belt; and a bill storage portion for storing the bill ejected from the nip portion between the tension roller on the downstream side and the pinch roller in contact with the tension roller, wherein:

(i) respective one of the nip portions between the tension rollers and the pinch rollers is set at a position offset by a predetermined angle formed in a direction perpendicular to a feeding direction of the bill from a lowest point of the tension rollers;

(ii) a distance between the pinch rollers in contact with the tension rollers on the upstream side and the downstream side is shorter than a distance between the tension rollers on the upstream side and the downstream side;

(iii) the nip portion on the upstream side, made up of the tension roller and the pinch roller on the upstream side is disposed at a position displaced by a predetermined angle from a rotation center of the tension roller on the upstream side toward the downstream side;

(iv) the nip portion on the downstream side made up of the tension roller and the pinch roller on the downstream side is disposed at a position displaced by a predetermined angle from a rotation center of the tension roller on the downstream side toward the upstream side;

the pair of pinch rollers are in press contact with the tension rollers on the upstream side and the downstream side while pinching the feeding belt, at the offset positions between the tension rollers on the upstream side and the downstream side;

the pinch roller and the tension roller on the upstream side are rotary-driven while being in press-contact with each other with the feeding belt interposed therebetween so that the bill inserted from the bill insertion slot is fed on the feeding belt from the nip portion on the upstream side, made up of the pinch roller and the tension roller in press-contact with each other;

the pinch roller and the tension roller on the downstream side are rotary-driven while being in press-contact with each other with the feeding belt interposed therebetween so that the bill fed toward the downstream side is ejected to the bill storage portion from the nip portion on the downstream side, made up of the pinch roller and the tension roller in press-contact with each other; and the bill storage portion is provided at a position extending downwardly of the tension roller on the downstream side so as to store the bill ejected from the nip portion between the tension roller and the pinch roller on the downstream side, the nip portion being offset toward the upstream side.

2. The bill handling device according to claim 1, wherein:

said pair of pinch rollers have a rotatable support shaft at a height substantially equal to the lowest point of said respective one of the tension rollers.

3. The bill handling device according to claim 1, further comprising:

a bill pressing device for pressing the bill ejected from the offset nip portion in a direction perpendicular to the feeding direction of the bill while the bill is oriented in a direction parallel to the feeding direction of the bill, and storing the bill in the bill storage portion.

4. The bill handling device according to claim 1, further comprising:

a drive unit for movably driving the bill storage portion on the upstream side so as to eject the bill storage portion from the bill insertion slot side through a downward side of said pair of pinch rollers.

* * * * *